US007793635B2

(12) United States Patent
Okamura

(10) Patent No.: US 7,793,635 B2
(45) Date of Patent: Sep. 14, 2010

(54) ROTARY PISTON TYPE INTERNAL COMBUSTION ENGINE

(75) Inventor: Toshio Okamura, Nishinomiya (JP)

(73) Assignee: Okamura Yugen Kaisha, Hyogo (JP)

( * ) Notice: Subject to any disclaimer, the term of this patent is extended or adjusted under 35 U.S.C. 154(b) by 495 days.

(21) Appl. No.: 11/792,438

(22) PCT Filed: May 9, 2006

(86) PCT No.: PCT/JP2006/309315

§ 371 (c)(1),
(2), (4) Date: Jun. 6, 2007

(87) PCT Pub. No.: WO2007/080660

PCT Pub. Date: Jul. 19, 2007

(65) Prior Publication Data

US 2009/0194065 A1 Aug. 6, 2009

(51) Int. Cl.

| | |
|---|---|
| ***F02B 53/00*** | (2006.01) |
| ***F02B 53/04*** | (2006.01) |
| ***F01C 9/00*** | (2006.01) |
| ***F04C 18/00*** | (2006.01) |
| ***F04C 2/00*** | (2006.01) |

(52) U.S. Cl. ..... 123/228; 123/18 A; 123/229; 418/35; 418/36

(58) Field of Classification Search ..... 123/201, 123/228–229, 233, 241, 244–248, 18 A; 418/34–38, 264

See application file for complete search history.

(56) References Cited

U.S. PATENT DOCUMENTS 892,201 A * 6/1908 Welsh et al. ..... 123/228
947,430 A * 1/1910 Jagersberger et al. ..... 123/228
964,933 A * 7/1910 Nicols ..... 418/246

(Continued)

FOREIGN PATENT DOCUMENTS

DE 4119622 A1 * 12/1992

(Continued)

OTHER PUBLICATIONS

A fully Certified English Translation of JP 03-286145 A, published on Dec. 17, 1991.*

(Continued)

*Primary Examiner*—Thai Ba Trieu
(74) *Attorney, Agent, or Firm*—Jordan and Hamburg LLP

(57) ABSTRACT

The rotary piston type internal combustion engine (E1) comprises an output shaft (1), a rotor (2), a housing (4), an annular operation chamber (5) formed by the rotor and housing on at least one side of the rotor in the axial direction of the output shaft for constituting an intake operation chamber, a compression operation chamber, a combustion operation chamber, and an exhaust operation chamber, a pressuring/pressured member (6) provided to the rotor for partitioning the annular operation chamber, two operation chamber partitions (7, 8) provided to the housing for partitioning the annular operation chamber, biasing mechanisms for biasing the operation chamber partitions toward their respective advanced positions, an intake port (11), an exhaust port (12), and a fuel injector (14), wherein the pressuring/pressured member (6) is constituted by an arc-shaped partition having first and second inclined surfaces and the operation chamber partitions (7, 8) are each constituted by a reciprocating partition reciprocating in parallel to the axis of the output shaft.

35 Claims, 16 Drawing Sheets

U.S. PATENT DOCUMENTS

| | | | | | |
|---|---|---|---|---|---|
| 968,630 | A | * | 8/1910 | Zimmer | 418/246 |
| 1,127,723 | A | * | 2/1915 | Beuoy | 123/201 |
| 1,138,215 | A | * | 5/1915 | Harford | 418/223 |
| 1,318,017 | A | * | 10/1919 | Shank | 123/206 |
| 1,879,422 | A | * | 9/1932 | Nash | 123/245 |
| 1,946,136 | A | * | 2/1934 | Farley | 418/36 |
| 2,127,743 | A | * | 8/1938 | Linthwaite | 123/18 A |
| 2,170,366 | A | * | 8/1939 | Dominguez | 418/246 |
| 2,248,029 | A | * | 7/1941 | Uzcudun et al. | 418/36 |
| 2,409,141 | A | * | 10/1946 | Margolis | 123/228 |
| 2,744,505 | A | * | 5/1956 | Sherman | 418/246 |
| 3,251,347 | A | * | 5/1966 | Farb | 418/35 |
| 3,714,930 | A | * | 2/1973 | Kelson, Sr. | 123/228 |
| 3,867,912 | A | * | 2/1975 | Parr et al. | 123/238 |
| 3,912,429 | A | * | 10/1975 | Stevenson | 418/246 |
| 3,923,032 | A | * | 12/1975 | Studenroth | 123/245 |
| 3,929,105 | A | | 12/1975 | Chisholm | 123/205 |
| 4,086,881 | A | * | 5/1978 | Rutten | 123/228 |
| 4,137,890 | A | | 2/1979 | Wohl | 123/205 |
| 4,178,900 | A | * | 12/1979 | Larson | 123/244 |
| 4,243,006 | A | * | 1/1981 | Quiroga | 123/247 |
| 4,337,741 | A | * | 7/1982 | McKenna et al. | 123/228 |
| 4,741,164 | A | * | 5/1988 | Slaughter | 60/627 |
| 4,890,990 | A | | 1/1990 | Zettner | 418/1 |
| 5,138,994 | A | * | 8/1992 | Maday | 123/248 |
| 5,404,850 | A | | 4/1995 | La Bell, Jr. | 123/263 |
| 5,979,395 | A | | 11/1999 | Mallen et al. | 123/243 |
| 6,062,188 | A | * | 5/2000 | Okamura | 123/228 |
| 6,119,649 | A | * | 9/2000 | Raab | 123/233 |
| 6,886,527 | B2 | * | 5/2005 | Regev | 123/245 |
| 7,117,842 | B2 | * | 10/2006 | Boehland et al. | 123/299 |
| 2005/0254968 | A1 | | 11/2005 | Patterson | 417/410.3 |

FOREIGN PATENT DOCUMENTS

| | | | |
|---|---|---|---|
| EP | 0 397 996 | | 11/1990 |
| JP | 15331 | | 12/1908 |
| JP | 45-9681 | | 4/1970 |
| JP | 52-32406 | | 8/1977 |
| JP | 54-134204 | | 10/1979 |
| JP | 55-12032 | | 1/1980 |
| JP | 02049927 | A * | 2/1990 |
| JP | 2-29841 | | 7/1990 |
| JP | 3-286145 | | 12/1991 |
| JP | 04066727 | A * | 3/1992 |
| JP | 10-61402 | | 3/1998 |
| JP | 2005-325840 | | 11/2005 |
| WO | WO- 94/13942 | | 6/1994 |
| WO | WO- 96/11334 | | 4/1996 |
| WO | WO- 2006/016358 | | 2/2006 |

OTHER PUBLICATIONS

A fully Certified English Translation of JP 52-032406 B2, published on Aug. 22, 1977.*

* cited by examiner

ROTARY PISTON TYPE INTERNAL COMBUSTION ENGINE

TECHNICAL FIELD

The present invention relates to a rotary piston type internal combustion engine and particularly relates to a unidirectional rotary engine in which an annular operation chamber is formed by one or both of sidewall portions of a rotor in the axial direction of the output shaft and a housing; the rotor comprises at least one pressuring/pressured member that partitions the annular operation chamber, and the housing comprises at least one operation chamber partitioning member, thereby realizing downsizing, high output power, and improved combustion and output performance and sealing and lubricating properties.

BACKGROUND ART

Reciprocating piston engines are extensively used because of their excellent combustion gas sealing and lubricating properties. However, the reciprocating engine tends to have a complex structure, be large in size, has high production cost, and cause vibrations. It is difficult to realize complete combustion in a reciprocating engine because the available combustion strokes depend on a crank angle not greater than 180 degrees. Furthermore, the crank mechanism properties set an upper limit on the conversion efficiency from combustion gas pressure to output power (torque, horsepower). The crank radius is determined according to the cylinder capacity. It is difficult to increase the crank radius and, accordingly, the output performance. In addition, in the case of a four-cycle engine, every two rotations of the crank shaft create one combustion stroke, hampering downsizing of the engine. In order to deal with this, the engine rotation speed is increased for higher output horsepower. This is disadvantageous because combustion performance is reduced as the engine rotation speed is increased.

Over the past 130 years or so, various rotary engines (rotary piston type internal combustion engines) have been proposed. However, they are all imperfect except for the Wankel rotary engine. Rotary engines are divided into two major groups including: a unidirectional rotary engine in which the rotor does not have an eccentric motion and the Wankel rotary engine in which the rotor has eccentric motion.

Approximately 12 years ago, the inventor of the present application proposed an unidirectional rotary piston type rotary engine cited in Patent Document 1, which has an annular operation chamber outside the outer periphery of the rotor. The rotor comprises a pressuring/pressured member partitioning the annular operation chamber. The housing comprises first and second oscillating partitions that partition the annular operation chamber, wherein the first partition opens/closes an auxiliary combustion chamber. Two sets of spring assemblies for elastically biasing the first and second partitions are respectively provided.

With this rotary engine, the annular operation chamber formed outside the outer periphery of the rotor and the two sets of spring assemblies make the engine greater in size. The first and second partitions and rotor make line-contact, not area-contact, with problems relating to hermetic sealing and lubricating properties.

Conversely, Patent Documents 2 to 5 have proposed various unidirectional rotary piston type rotary engines. The rotary engine described in Patent Document 2 has an approximately 240 degrees arc-shaped intake/compression groove formed on a sidewall of the rotor, a partition biased by a spring and partitioning the intake/compression groove, an arc-shaped expansion/exhaust groove formed on the outer periphery of the rotor, and a compression/explosion chamber formed in a protrusion of the housing.

The rotary engine of Patent Document 3 is a vane type rotary engine having a rotor eccentrically installed in the circular retention hole of a housing, an output shaft passing through the center of the rotor, eight vanes mounted on the rotor in a radially reciprocating manner, and an auxiliary combustion chamber formed on the outer periphery side of the circular retention hole.

The rotary engine of Patent Document 4 has a rotor concentrically installed in the circular retention hole of a housing, an intake groove formed by cutting out the outer periphery of the rotor into an arc (a crescent) shape, a partition mounted on the housing and abutting the outer periphery of the rotor, and a cam mechanism for radially moving the partition.

The rotary engine of Patent Document 5 has a housing, a nearly oval rotor retained in a circular retention chamber in the housing, two partitions biased by springs, a timing rotor retained in a circular hole situated next to the circular retention chamber via an middle side plate, an arc-shaped main combustion chamber formed on the outer periphery of the timing rotor, an auxiliary combustion chamber formed outside the outer periphery of the main combustion chamber, a heating plug facing the auxiliary combustion chamber, and a secondary injection nozzle. Fuel-air mixture pressurized by the rotor in the intake/compression chamber is introduced into the auxiliary combustion chamber, where it is compressed and ignited. The combustion gas is introduced into the expansion/exhaust chamber among the circular retention chambers via the main combustion chamber, enabling the combustion gas to work on the rotor.

Patent Document 1: WO96/11334;

Patent Document 2: Japanese Patent Laid-Open Publication No. S52-32406;

Patent Document 3: U.S. Publication No. 5,979,395;

Patent Document 4: Japanese Laid-Open Patent Publication No. H10-61402; and

Patent Document 5: Japanese Laid-Open Patent Publication No. 2002-227655

SUMMARY OF THE INVENTION

Problems to be Solved by the Invention

It is difficult to maintain sealing property or ensure lubricating property in supplying lubricating oil to the sliding parts and durability in a structure in which the forefront of an oscillating partition that partitions the operation chamber makes line-contact with the outer periphery of the rotor for hermetic sealing as in the rotary engine of Patent Document 1. The rotary engine of Patent Document 2 has an expansion/exhaust groove (combustion operation chamber) on the outer periphery side of the rotor, which enlarges the engine. The combustion stroke spans over a rotation angle of approximately 120 degrees of the output shaft; therefore, making it difficult to achieve complete combustion. The rotor receives not only forward rotational torque but also reverse rotational torque in the later stage of the combustion stroke, which does not improve output performance. Furthermore, the compression/explosion section largely protruding upward, increasing the height of the engine. The arc-shaped intake/compression groove is formed on the rotor sidewall; however, the combustion operation chamber is not, with ineffective use of the space on the rotor sidewall.

The rotary engine of Patent Document 3 has the operation chamber on the outer periphery side of the rotor, increasing the engine size. Forward rotation torque is generated to drive the rotor while the engine rotates. Combustion gas within vane cells between vanes generates not only forward rotation torque but also large reverse rotation torque, making it difficult to increase the output performance.

The rotary engine of Patent Document 4 has the combustion operation chamber on the outer periphery of the rotor, which increases the engine in size. The cylindrical partition makes line-contact with the outer periphery of the rotor, failing to ensure the hermetic sealing of combustion gas or to improve durability.

A tall partition and a cam mechanism driving it protrude upward, significantly increasing the height of the engine. Not only forward rotation torque but also reverse rotation torque is generated in the later stage of the combustion stroke, making it difficult to increase the output performance.

The rotary engine of Patent Document 5 has an oval rotor with a rotor head having a large curvature. When the engine is rotated at a higher speed, the partition cannot follow the rotation of the rotor and may jump. The operation chamber is formed on the outer periphery side of the rotor. A radial partition that partitions the operation chamber is provided on the outer periphery side of the rotor, increasing the engine size.

The prior art unidirectional rotary engine has sought a rotary engine having the operation chamber in the space on the outer periphery side of the rotor. The engine has never been successfully downsized due to lack of effectively using the rotor side space in the axial direction of the output shaft to form an annular operation chamber. It is also difficult to increase the combustion stroke to a rotation angle greater than 180 degrees of the output shaft, which sets an upper limit on the combustion performance. Furthermore, the rotor cannot be shared by multiple sets of engine.

The objects of the present invention are to provide a rotary piston type rotary engine that is advantageous to downsizing, to provide a rotary piston type combustion engine having sliding parts making area-contact for hermetic sealing, to provide a rotary piston type combustion engine effectively using the rotor side space in the axial direction of the output shaft to form an annular operation chamber, to provide a rotary piston type combustion engine having a sufficiently large combustion stroke, and to provide a rotary piston type combustion engine in which the rotor is shared by multiple engines.

Means for Solving Problems

The present invention provides a rotary piston type internal combustion engine comprising an output shaft, a rotor coupled to the output shaft with no relative rotation, a housing rotatably supporting the output shaft, an annular operation chamber formed by the rotor and housing, at least one pressuring/pressured member provided to the rotor for partitioning the annular operation chamber, at least one operation chamber partitioning member provided to the housing for partitioning the annular operation chamber, an intake port for introducing intake air into the annular operation chamber, an exhaust port for exhausting gas from the annular operation chamber, and a fuel supply means for supplying fuel, wherein compressed fuel-air mixture is ignited using a spark plug or compression ignition, wherein the annular operation chamber is formed by at least one of sidewall portions of the rotor in the axial direction of the output shaft and the housing, and has an entirely or mostly cylindrical inner peripheral wall and an entirely or mostly cylindrical outer peripheral wall; one of the pressuring/pressured member and operation chamber partitioning member is constituted by a reciprocating partitioning member that reciprocates in parallel to the axis of the output shaft between an advanced position where it partitions the annular operation chamber and a retracted position where it is retracted from the annular operation chamber; a biasing means for biasing the reciprocating partitioning member toward the advanced position is provided; and the other of the pressuring/pressured member and operation chamber partitioning member is constituted by an arc-shaped partitioning member having a first inclined surface for driving the reciprocating partitioning member from the advanced position to the retracted position, a forefront sliding surface continued from the first inclined surface, and a second inclined surface continued from the forefront sliding surface and allowing the reciprocating partitioning member to return from the retracted position to the advanced position.

Advantages of the Invention

Operation and advantages of the engine of the present invention is described hereafter.

The annular operation chamber is formed by at least one of sidewall portions of the rotor and the housing. The annular operation chamber is hermetically partitioned by at least one pressuring/pressured member provided to the rotor and by at least one operation chamber partitioning member provided to the housing. The pressuring/pressured member is capable of compressing intake air in cooperation with the operation chamber partitioning member and receiving combustion gas pressure as the rotor rotates.

As the rotor rotates, the reciprocating partitioning member moves reciprocatively between its advanced position and its retracted position while making contact with the first inclined surface, forefront sliding surface, and second inclined surface of the arc-shaped partition in sequence.

For example, when the pressuring/pressured member is constituted by the arc-shaped partitioning member and the operation chamber partitioning member is constituted by the reciprocating partitioning member, the arc-shaped partitioning member has an inner peripheral side sliding surface making area-contact with the inner peripheral surface of the annular operation chamber, an outer peripheral side sliding surface making area-contact with the outer peripheral surface of the annular operation chamber, and a forefront sliding surface making area-contact with the housing side annular wall of the annular operation chamber. The reciprocating partitioning member has a forefront sliding surface making area-contact with the rotor side annular wall. The reciprocating partitioning member does not make relative movement to the housing in the circumferential direction; which is advantageous for hermetic sealing. An engaging guide mechanism for inhibiting relative movement of the reciprocating partitioning member to the housing in the circumferential direction can be provided.

The annular operation chamber is formed by at least one sidewall portion of the rotor and the housing. Therefore, there is no member largely protruding outward from the outer periphery of the rotor, which contributes to downsizing of the internal combustion engine. Both the arc-shaped partitioning member and the reciprocating partitioning member can make area-contact with the walls of the annular operation chamber, easily assuring sealing and lubricating properties.

The annular operation chamber is formed by at least one sidewall portion of the rotor in the axial direction of the output shaft and the housing. Therefore, the annular operation chamber can have a maximized radius within the diameter of the rotor. In such a case, the radius from the output shaft to the pressuring/pressured member receiving combustion gas pressure (which corresponds to the crank radius) can be significantly greater than the crank radius of a reciprocating engine. Combustion gas pressure is converted to output (torque, horsepower) with a significantly increased efficiency, achieving an internal combustion engine having high fuel economical efficiency.

For example, when the rotor comprises one arc-shaped partitioning member and the housing comprises two reciprocating partitioning members, every one rotation of the output shaft realizes one combustion stroke, which reduces the cylinder capacity to half the cylinder capacity of a four-cycle engine, realizing a significantly downsized engine. The combustion stroke can span over a rotation angle of approximately 180 or greater of the output shaft. A prolonged combustion period and increased combustion performance can be realized. The annular operation chamber can be provided on either side of the rotor and the one rotor can be shared by two sets of internal combustion engine, advantageous to achieving a downsized, high power internal combustion engine.

On the other hand, when most part of the annular operation chamber is formed in the rotor, it is preferable that the rotor comprises the reciprocating partitioning member as the pressuring/pressured member and the housing comprises the arc-shaped partitioning member as the operation chamber partitioning member. In such a case, the same advantages as described above can be expected.

The following various structures can be applied to the present invention.

(1) The annular operation chamber can constitute an intake operation chamber, a compression operation chamber, a combustion operation chamber, and an exhaust operation chamber by means of the pressuring/pressured member and operation chamber partitioning member.

(2) The sidewall portion of the rotor is the larger-diameter sidewall portion having a radius of 0.5R or greater from the axis of the output shaft in which R is the radius of the rotor.

(3) The annular operation chamber is constituted by an annular groove recessed in the housing with an opening end facing the rotor and having a rectangular half section in a plane containing the axis of the output shaft and an annular wall of the rotor closing the opening end of the annular groove.

(4) The annular operation chamber has a rectangular half section with arc-like rounded corners in a plane containing the axis of the output shaft and is constituted by a shallow annular groove formed in the rotor and a deep annular groove formed in the housing; the shallow annular groove has a first annular wall on a plane orthogonal to the axis of the output shaft and inner and outer corner walls that are on the inner peripheral side and on the outer peripheral side of the first annular wall; and the deep annular groove has an inner cylindrical wall, an outer cylindrical wall, a second annular wall on a plane orthogonal to the axis of the output shaft, and inner and outer corner walls that are on the inner peripheral side and on the outer peripheral side of the second annular wall.

(5) An engaging guide mechanism that inhibits the reciprocating partitioning member from moving in the circumferential direction and allows the reciprocating partitioning member to move in parallel to the axis of the output shaft is provided.

(6) The biasing means is constituted by a gas spring biasing the reciprocating partitioning member toward the advanced position.

(7) The annular operation chamber is provided on either side of the rotor in the axial direction of the output shaft and these annular operation chambers each is provided with the pressuring/pressured member and the operation chamber partitioning member.

(8) The annular operation chamber has a wall parallel to a plane orthogonal to the axis of the output shaft; and the reciprocating partitioning member has on the forefront end a first sliding surface for making hermetic contact with the first inclined surface of the arc-shaped partitioning member, a forefront sliding surface for making hermetic contact with the wall of the annular operation chamber that is parallel to a plane orthogonal to the axis of the output shaft, and a second sliding surface for making hermetic contact with the second inclined surface of the arc-shaped partitioning member.

(9) The arc-shaped partitioning member has an inner peripheral side sliding surface making contact with the inner peripheral wall and an outer peripheral side sliding surface making contact with the outer peripheral wall and the inner and outer peripheral side sliding surfaces of the arc-shaped partitioning member are each provided with a seal-installation groove to which lubricating oil is supplied and one or more sealing members movably installed in the seal-installation groove.

(10) In the above (8), the reciprocating partitioning member has an inner peripheral side sliding surface and an outer peripheral side sliding surface and the inner and outer peripheral side sliding surfaces and first, forefront, and second sliding surfaces of the reciprocating partitioning member are each provided with one or more seal-installation grooves to which lubricating oil is supplied and one or more sealing members movably installed in the seal-installation groove.

(11) In the above (8), the leading end in the rotor rotation direction of the first inclined surface of the arc-shaped partitioning member is on a line orthogonal to the axis of the output shaft, the first inclined surface has a circumferential inclination progressively decreased in the radially outward direction, the trailing end in the rotor rotation direction of the second inclined surface of the arc-shaped partitioning member is on a line orthogonal to the axis of the output shaft, and the second inclined surface has a circumferential inclination progressively decreased in the radially outward direction.

(12) The pressuring/pressured member provided to the rotor is constituted by the arc-shaped partitioning member and the housing is provided with as the operation chamber partitioning member a first reciprocating partitioning member and a second reciprocating partitioning member spaced from the first reciprocating partitioning member by at least 180 degrees in the rotor rotation direction.

(13) In the above (12), an auxiliary combustion chamber is formed in a wall portion of the housing on an output shaft side than the first reciprocating partitioning member, the intake port is formed in a portion of the housing near the second reciprocating partitioning member at the leading side in the rotor rotation direction than the second reciprocating partitioning member, and the exhaust port is formed in a portion of the housing near the second reciprocating partitioning member at the trailing side in the rotor rotation direction than the second reciprocating partitioning member.

(14) In the above (13), when the pressuring/pressured member is between the intake port and the first reciprocating partitioning member, the intake operation chamber is formed between the second reciprocating partitioning member and the pressuring/pressured member and the compression operation chamber is formed between the pressuring/pressured member and the first reciprocating partitioning member in the annular operation chamber; and when the pressuring/pressured member is between the first reciprocating partitioning member and the exhaust port, the combustion operation chamber is formed between the first reciprocating partitioning member and the pressuring/pressured member and the exhaust operation chamber is formed between the pressuring/pressured member and the second reciprocating partitioning member in the annular operation chamber.

(15) In the above (14), the fuel supply means has a fuel injector for injecting fuel into the compression operation chamber.

(16) In the above (14), the fuel supply means has a fuel injector for injecting fuel into the auxiliary combustion chamber.

(17) In the above (15), the fuel supply means has a fuel injector that additionally injects fuel into the combustion operation chamber.

(18) In the above (14), an inlet passage for connecting the compression operation chamber to the auxiliary combustion chamber, an inlet passage on-off valve for opening/closing the inlet passage, an outlet passage for discharging combustion gas in the auxiliary combustion chamber into the combustion operation chamber, and an outlet passage on-off valve for opening/closing the outlet passage are provided.

(19) In the above (18), multiple valve-driving means for driving the inlet passage on-off valve and outlet passage on-off valve in synchronism with the rotation of the output shaft are provided.

(20) The operation chamber partitioning member is constituted by the reciprocating partitioning member and an auxiliary chamber is formed within the reciprocating partitioning member.

(21) The pressuring/pressured member is constituted by the reciprocating partitioning member, the housing is provided with as the operation chamber partitioning member one or a multiple number of the arc-shaped partitioning members, and an auxiliary combustion chamber is formed at least one of the arc-shaped partitioning members.

(22) The rotor is provided with as the pressuring/pressured member one of the arc-shaped partitioning member; the housing is provided with as the operation chamber partitioning member one reciprocating partitioning member; an intake port is formed in a portion of the housing at the leading side in the rotor rotation direction than the reciprocating partitioning member and an exhaust port is formed in the housing near said reciprocating partitioning member at the trailing side in the rotor rotation direction than the reciprocating partitioning member; and an intake valve for opening/closing the intake port and an exhaust valve for opening/closing the exhaust port are provided.

(23) In the above (11), the rotor is provided with as the pressuring/pressured member two of the arc-shaped partitioning members spaced from each other by approximately 180 degrees in the rotor rotation direction.

(24) In the above (12), the rotor is provided with as the pressuring/pressured member three of the arc-shaped partitioning members provided at trisected positions on the circumference.

(25) The rotor is provided with as the pressuring/pressured member four of the arc-shaped partitioning members provided at quadrisected positions on a circumference and the housing is provided with as the operation chamber partitioning member four reciprocating partitioning members provided at quadrisected positions on a circumference; the intake ports are formed in the housing near leading ends in the rotor rotation direction of the two reciprocating partitioning members spaced by 180 degrees in the circumferential direction and the exhaust ports are formed in the housing near trailing ends in the rotor rotation direction thereof.

(26) Multiple annular operation chambers having different sizes are provided on at least one sidewall portion of the rotor concentrically with radial intervals, the rotor is provided with at least one pressuring/pressured member that partitions each annular operation chamber, and the housing is provided with at least one operation chamber partitioning member that partitions each annular operation chamber.

(27) The fuel supply means has a fuel injector for injecting fuel into the auxiliary combustion chamber and fuel-air mixture in the auxiliary combustion chamber is ignited using compression ignition.

The above structures, other basic structure, and modified embodiments of the present invention and their operations and effects are described in detail using embodiments described later.

EXPLANATION OF NUMERALS

Figure 1:
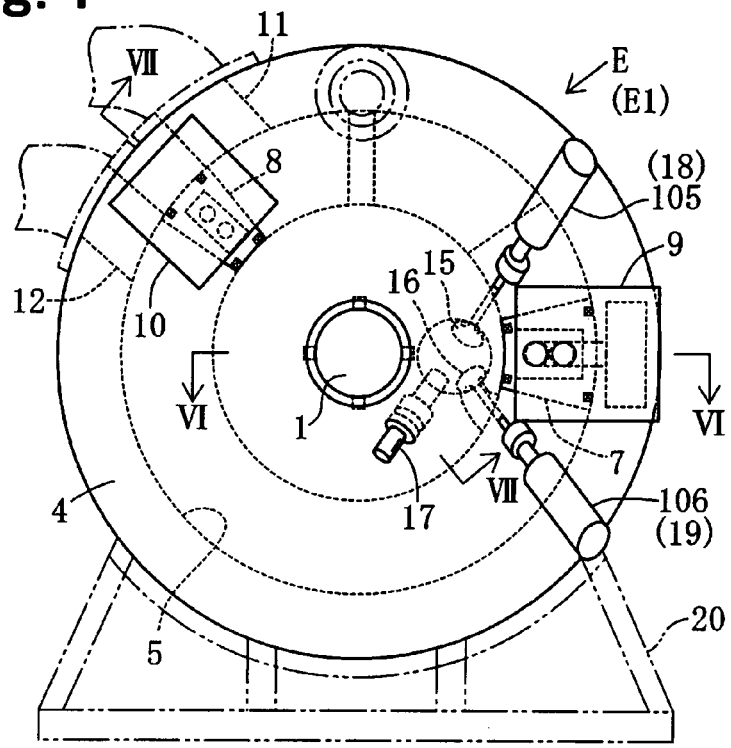
[FIG. 1] A right side view of a rotary engine of an embodiment of the present invention.

1 output shaft
2 rotor
4 housing
5 annular operation chamber
6 arc-shaped partitioning member
7,8 first and second reciprocating partitioning members
9, 10 gas spring
11 intake port
12 exhaust port
13 auxiliary combustion chamber
15, 16 first and second on-off valves
18, 19 valve-driving mechanism
25 annular groove
25*a*, 25*b* inner and outer peripheral walls
26 rotor annular wall
41, 43 first and second inclined surfaces
42 forefront sliding surface
58, 59 first and second sliding surfaces

DETAILED DESCRIPTION OF THE PREFERRED EMBODIMENTS

The present invention relates to a rotary piston type internal combustion engine (termed "rotary engine" hereafter) comprising an output shaft, a rotor coupled to the output shaft with no relative rotation, a housing rotatably supporting the output shaft, an annular operation chamber formed by the rotor and housing, at least one pressuring/pressured member provided to the rotor for partitioning the annular operation chamber, at least one operation chamber partitioning member provided to the housing for partitioning the annular operation chamber, an intake port for introducing intake air into the annular operation chamber, an exhaust port for exhausting gas from the annular operation chamber, and a fuel supply means for supplying fuel, wherein compressed fuel-air mixture is ignited using a spark plug or compression ignition.

Particularly, the present invention has the following characteristic structures. The annular operation chamber is formed by at least one of sidewall portions of the rotor in the axial direction of the output shaft and the housing and has an entirely or mostly cylindrical inner peripheral wall and an entirely or mostly cylindrical outer peripheral wall.

One of the pressuring/pressured member and operation chamber partitioning member is constituted by a reciprocating partitioning member reciprocating in parallel to the axis of the output shaft between an advanced position where it partitions the annular operation chamber and a retracted position where it is retracted from the annular operation chamber. A biasing means for biasing the reciprocating partitioning member toward the advanced position is provided.

The other of the pressuring/pressured member and operation chamber partitioning member is constituted by an arc-shaped partitioning member having a first inclined surface that drives the reciprocating partitioning member from the advanced position to the retracted position, a forefront sliding surface continued from the first inclined surface, and a second inclined surface continued from the forefront sliding surface and allowing the reciprocating partitioning member to return from the retracted position to the advanced position.

Embodiment 1

Figure 2:
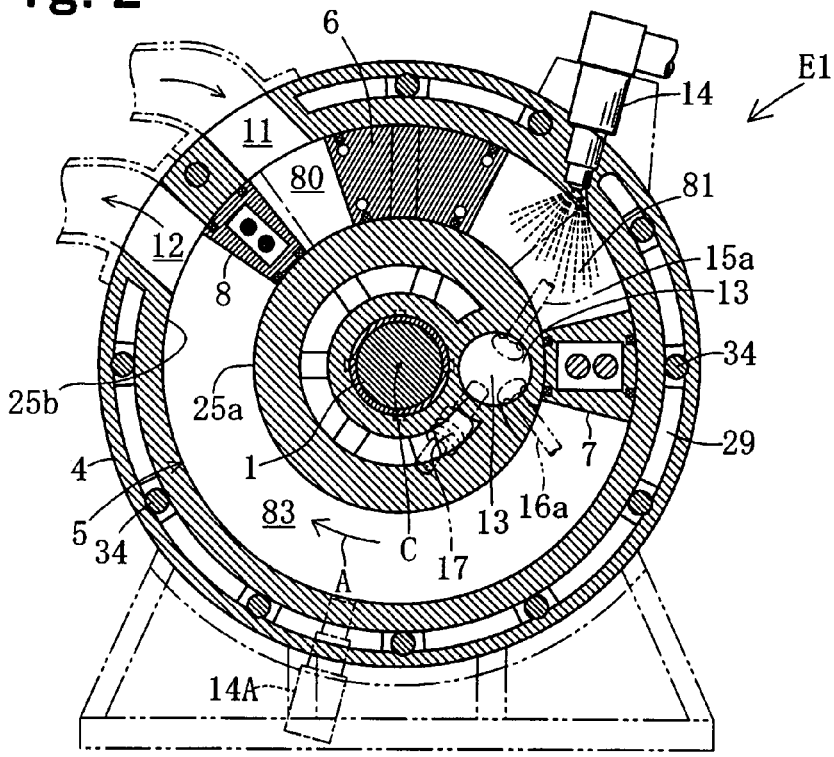
[FIG. 2] A vertical cross-sectional view of the rotary engine.

The rotary engine of Embodiment 1 is described with reference to FIGS. 1 to 28. As shown in FIGS. 1, 2, and 5, a rotary engine E has two sets of rotary engines (the right side rotary engine E1 and the left side rotary engine E2 in FIG. 5) sharing an output shaft 1, a rotor 2, and a rotor housing 3. The rotary engines E1, E2 are symmetrical about the vertical center line CL passing through the central axis of the output shaft 1 and the center of the rotor 2 in the horizontal direction as shown in FIG. 5, but timing of their respective strokes are set with a rotational phase difference of 180°, as operationally explained in greater detail herein with reference to FIGS. 17 to 26. Accordingly, the right side rotory engine E1 is mainly described.

As shown in FIGS. 1 to 7, the rotary engine E1 comprises an output shaft 1, a rotor 2 equivalent to a rotary piston, a housing 4 provided on one side (on the right side in FIG. 5) of the rotor 2, a rotor housing 3, an annular operation chamber 5 formed by the rotor 2 and housing 4, an arc-shaped partitioning member 6 provided to the rotor 2 for serving as a pressuring/pressured member, first and second reciprocating partitioning members 7, 8 provided to the housing 4 for serving as operation chamber partitioning members, first and second gas springs 9, 10, an intake port 11, an exhaust port 12, an auxiliary combustion chamber 13, a fuel injector 14, inlet and outlet passage on-off valves 15, 16, a spark plug 17, valve-driving mechanisms 18, 19 (see FIG. 14), and a base frame 20.

As shown in FIGS. 1 to 7, the output shaft 1 passes through the central portions of the rotor 2 and two housings 4, 4. The rotor 2 is constituted by a circular plate of a specific thickness having a cooling water passage 2*a* therein. The rotor 2 is coupled to the output shaft 1 with no relative rotation via a key. The rotor 2 is disposed to be orthogonal to the output shaft 1. The rotor 2 and housing 4 are preferably made of a metal material having excellent solid lubricating property such as nodular graphite cast iron; however, they can be made of other various metal materials such as cast steel or non-metal materials such as ceramic.

Figure 3:
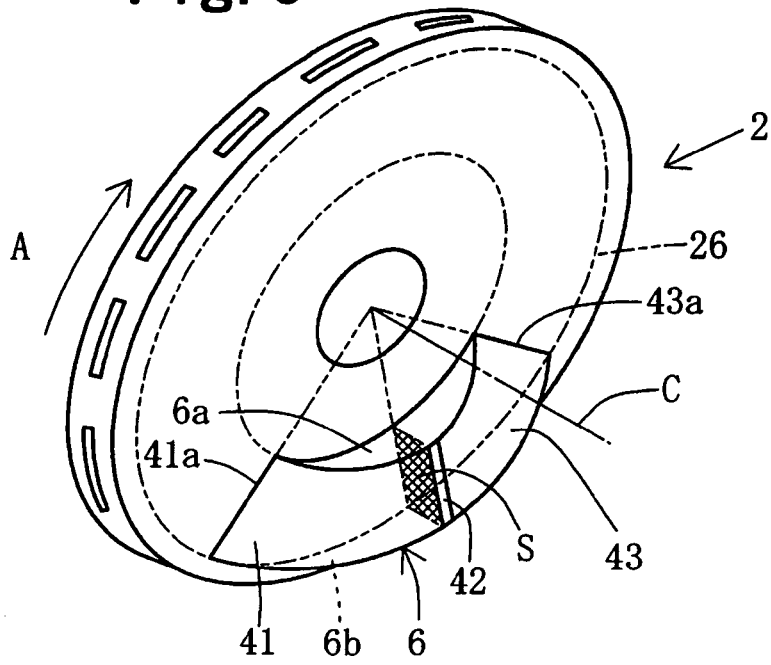
[FIG. 3] A schematic perspective view of the rotor.

In FIGS. 1 to 3, the rotor 2 rotates clockwise (in the arrowed direction A). "The leading side" means forward in the rotation direction of the rotor 2 and "the trailing side" means backward in the rotation direction of the rotor 2. "the axis" is the axis C of the output shaft 1 unless particularly otherwise specified.

As shown in FIGS. 2, 3, the arc-shaped partitioning member 6 hermetically partitioning the annular operation chamber 5 is integrally formed on one side (on the right side) of the rotor 2 in the axial direction of the output shaft 1. The arc-shaped partitioning member 6 is formed on the right sidewall of the rotor 2 in the larger-diameter area radially corresponding to the annular operation chamber 5.

Figure 4:
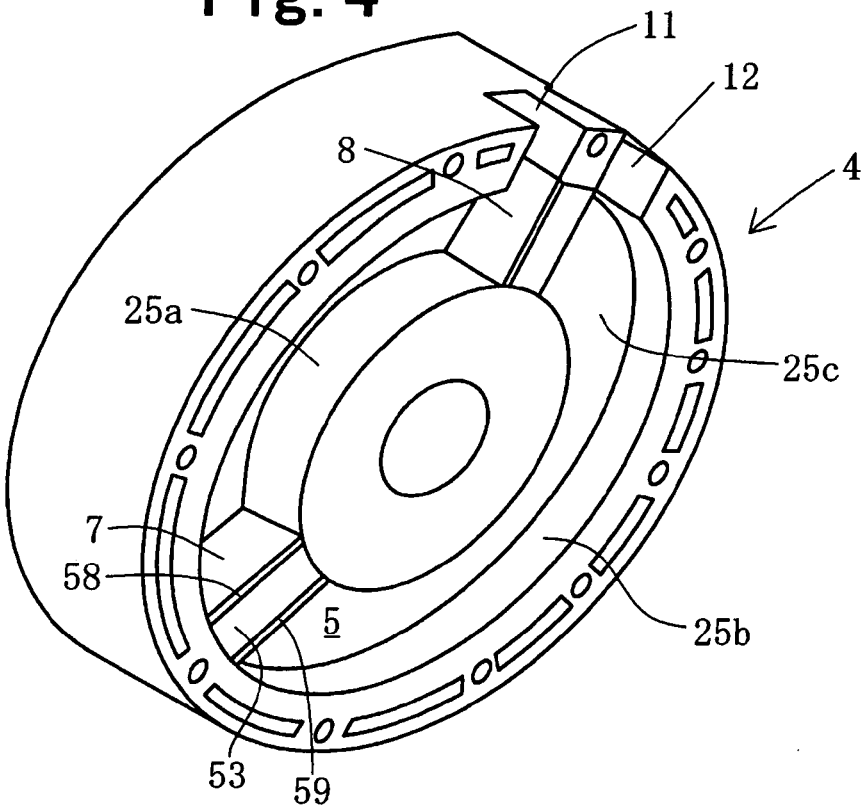
[FIG. 4] A schematic perspective view of the housing.
Figure 5:
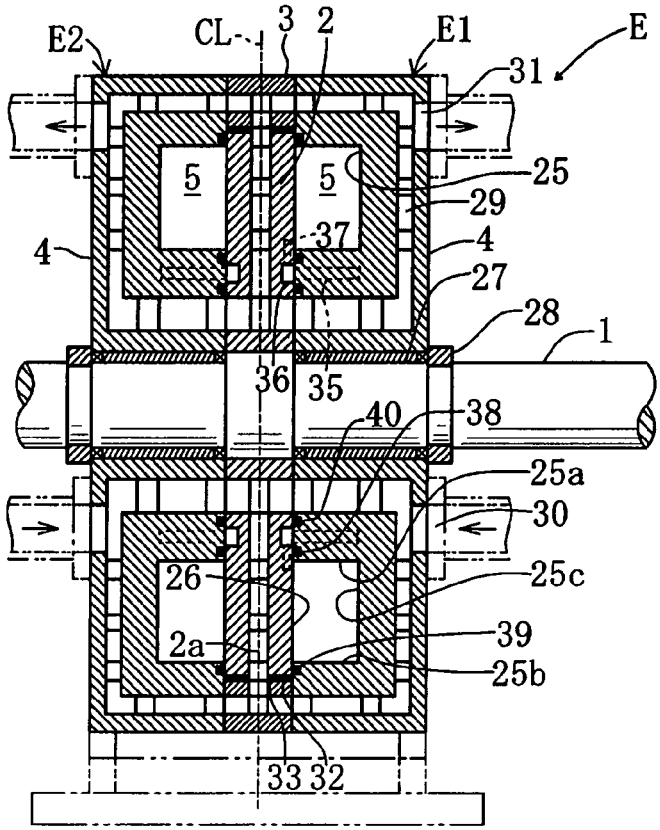
[FIG. 5] A vertical cross-sectional front view of the rotary engine.

As shown in FIGS. 2, 4, 5, the annular operation chamber 5 is used to constitute an intake operation chamber, a compression operation chamber, a combustion operation chamber, and an exhaust operation chamber. The annular operation chamber 5 has an annular shape formed by the housing 4 and rotor 2 around the axis of the output shaft 1. The annular operation chamber 5 is formed by the larger-diameter area of at least one (right) sidewall of the rotor 2 in the axial direction of the output shaft 1 and the housing 4. In other words, the annular operation chamber 5 faces the larger-diameter area of at least one (right) sidewall of the rotor 2 and that larger-diameter area serves as the rotor 2 side sidewall of the annular operation chamber 5.

The annular operation chamber 5 is formed by the larger-diameter sidewall portion of the sidewall of the rotor 2 having a radius of 0.5R and greater from the axis of the output shaft 1 in which R is the radius of the rotor 2 and the housing 4. This is to increase the radius (equivalent to the crank radius) from the axis of the output shaft 1 to the arc-shaped partitioning member 6 receiving combustion gas pressure as much as possible so as to generate output (torque, horsepower) as large as possible.

As shown in FIGS. 2, 4, 5, the annular operation chamber 5 is constituted with an annular groove 25 recessed in the housing 4, and having a rectangular half-section in a plane containing the axis of the output shaft 1 and an annular wall 26 (including first and second inclined surface 41 and 43, which are described later) closing the opening end of the annular groove 25. The annular groove 25 has an inner peripheral wall 25*a* that is entirely cylindrical around the axis, an outer peripheral wall 25*b* that is entirely cylindrical around the axis, and an annular wall 25*c* orthogonal to the axis. The annular groove 25 can have a rectangular or square half section. The square is desirable for a smaller wall area leading to increased combustion performance in the combustion operation chamber described later. On the other hand, the rectangular as shown in the figures is desirable for smaller reciprocating movement of the first and second reciprocating partitioning members 7, 8. The rotor 2 can be constituted by multiple parts to form a cooling water passage.

The housing 4 is constituted by a circular member having a thickness approximately two times greater than the rotor 2 and a diameter greater than the rotor 2. The output shaft 1 passes through the central portion of the housing 4 and a bearing 27 is inserted between the output shaft 1 and the housing 4. The bearing 27 is supplied with lubricating oil through an oil passage formed in the wall of the housing 4. The housing 4 is positioned on the output shaft 1 by means of a stopper rings 28.

The housing 4 has an intake port 11 and an exhaust port 12. A cooling water passage 29 is formed in the housing 4. The housing 4 also has a cooling water inlet port 30 and a cooling water outlet port 31. The rotor housing 3 is fitted on the rotor 2 via a bearing 32 and a sealing member 33. The housing 4 is mounted in area-contact with the sidewalls of the rotor 2 and rotor housing 3. The rotor housing 3 and two housings 4, 4 are coupled, for example, by 11 bolts 34 (see FIG. 2) introduced through them near the outer circumference.

As shown in FIG. 5, the housing 4 has an oil passage 35 and not-shown multiple oil passages through which pressurized lubricating oil is supplied from an external source. The rotor 2 has an annular oil passage 36 connected to the oil passage 35 and multiple oil passages 37 connected to the annular oil passage 36. The bearing 32 is supplied with lubricating oil through the oil passages 37.

Annular sealing members 38, 39, 40 for sealing between the rotor 2 and the housing 4 are installed in seal-installation grooves to which lubricating oil is supplied. The sealing members 38 to 40 are preferably made of a metal material having excellent wear proof and solid lubricating property.

As shown in FIGS. 2, 3, 8, 9, the arc-shaped partitioning member 6 integrated with the rotor 2 has a first inclined surface 41 for driving the first and second reciprocating partitioning members 7, 8 from their advanced positions to their retracted positions, a forefront sliding surface 42 continued from the inclined surface 41, and a second inclined surface 43 continued from the forefront sliding surface 42 and allowing the first and second reciprocating partitioning members 7, 8 to return from their retracted positions to their advanced positions. The first and second inclined surfaces 41, 43 are linearly inclined in the circumferential direction. The connection part between the first inclined surface 41 and the forefront sliding surface 42 forms a smooth, continuous curved surface. This connection part is positioned on a line orthogonal to the axis of the output shaft 1. The connection part between the forefront sliding surface 42 and the second inclined surface 43 forms a smooth, continuous curved surface. This connection part is positioned on a line orthogonal to the axis of the output shaft 1. The forefront sliding surface 42 makes hermetic area-contact with the annular wall 25*c*. As shown in FIGS. 3, 10, the first inclined surface 41 has a leading end 41*a* on a line orthogonal to the axis of the output shaft 1. The end 41*a* has a curved surface, not a bent surface. The first inclined surface 41 has a circumferential inclination linearly decreased in the radially outward direction. The second inclined surface 43 has a trailing end 43*a* on a line orthogonal to the axis of the output shaft 1. The end 43*a* has a curved surface, not a bent surface. The second inclined surface 43 has a circumferential inclination linearly decreased in the radially outward direction. Preferably, the first inclined surface 41 has an average circumferential inclination of, for example, approximately ⅕ to ⅓ and the second inclined surface 43 has an average circumferential inclination of, for example, approximately ¼ to ½. In the example of FIG. 10, $\alpha>\beta$ and $(\alpha+\beta)$ is approximately 90 to 100 degrees. However, $\alpha=\beta$ is also acceptable.

It is possible in large-size rotary engines that the first inclined surface 41 has a circumferential inclination of smaller than ⅕ and the second inclined surface 43 has a circumferential inclination of smaller than ¼.

Figure 8:
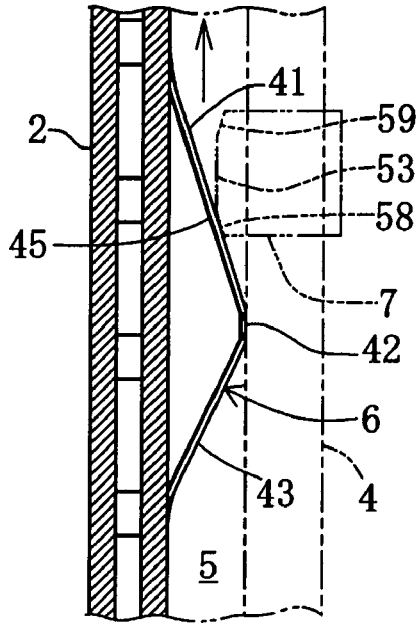
[FIG. 8] An illustration for explaining the behavior of the arc-shaped partitioning member and first reciprocating partitioning member.
Figure 9:
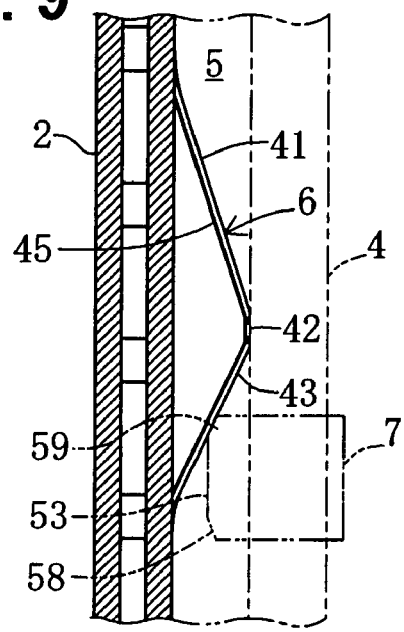
[FIG. 9] An illustration for explaining the behavior of the arc-shaped partitioning member and first reciprocating partitioning member.
Figure 10:
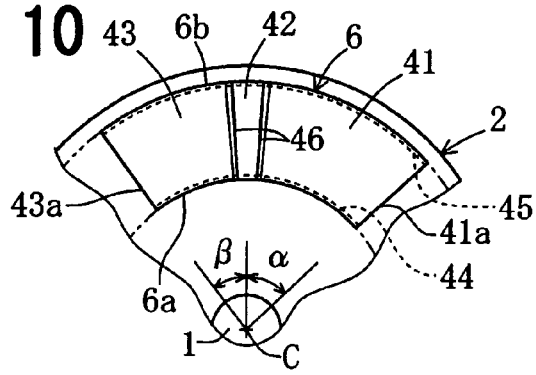
[FIG. 10] A side view of the core part of the rotor including the arc-shaped partitioning member.
Figure 11:
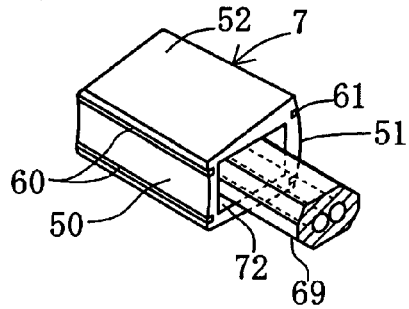
[FIG. 11] A perspective view of the first reciprocating partitioning member and the guide case of the first gas spring.
Figure 12:
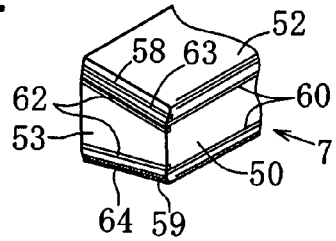
[FIG. 12] A perspective view of the forefront part of the first reciprocating partitioning member.
Figure 13:
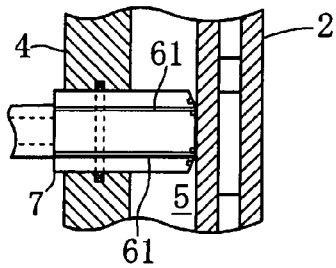
[FIG. 13] A cross-sectional view showing the outer peripheral side sliding surface of the first reciprocating partitioning member.

As shown in FIGS. 8 to 10, the arc-shaped partitioning member 6 has an inner peripheral side sliding surface 6*a* and an outer peripheral side sliding surface 6*b*. The inner and outer peripheral side sliding surfaces 6*a*, 6*b* and forefront sliding surface 42 have one or more seal-installation grooves to which lubricating oil is supplied from the annular oil passage 36 and oil passages 37 and sealing members 44 to 46 movably installed in the seal-installation grooves, respectively. The sealing members 44, 45 are installed near the ridge lines of the first and second inclined surfaces 41, 43 and two sealing members 46 are installed in the forefront sliding surface 42. The sealing members 44 to 46 are biased toward the advanced positions by lubricating oil pressure. A structure for preventing the sealing members 44 to 46 from coming off the seal-installation grooves or a structure for biasing the sealing members 44 to 46 using plate springs installed in the seal-installation grooves can be utilized as appropriate.

Figure 6:
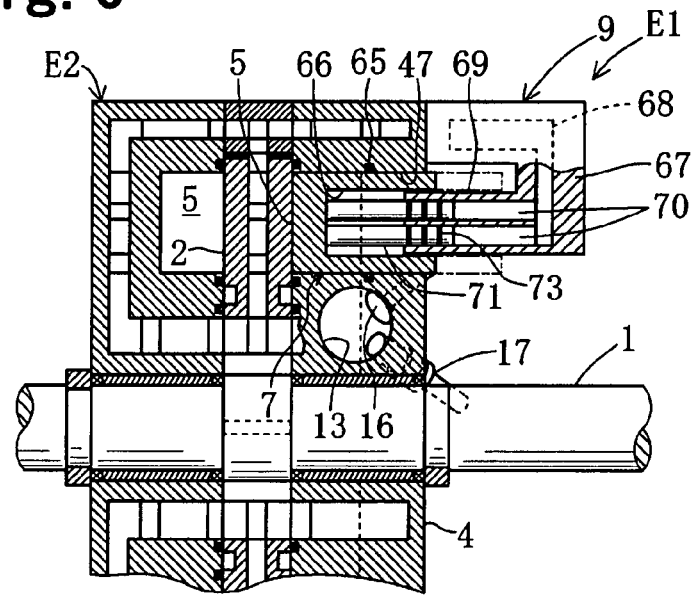
[FIG. 6] A cross-sectional view at the line VI-VI in FIG. 1.

As shown in FIGS. 2, 4, 6, on the housing 4, there are provided with a first reciprocating partitioning member 7 and a second reciprocating partitioning member 8 spaced from the first reciprocating partitioning member 7 by approximately 200 degrees from the leading end thereof. The first and second reciprocating partitioning members 7, 8 can reciprocate between their advanced position where they partition the annular operation chamber 5 and their retracted position where they are retracted from the annular operation chamber 5 in parallel to the axis of the output shaft 1. The first and second reciprocating partitioning members 7, 8 each have durability and rigidity against gas pressure applied to them. A first gas spring 9 is provided as a biasing means for biasing the first reciprocating partitioning member 7 toward its advanced position and a second gas spring 10 is provided as a biasing means for biasing the second reciprocating partitioning member 8 toward its advanced position.

As shown in FIGS. 2, 4, 6, and 11 to 13, the first reciprocating partitioning member 7 is hermetically and slidably installed in a guide hole 47 formed in the housing 4. The first reciprocating partitioning member 7 has an inner peripheral side sliding surface 50 making hermetic area-contact with the inner peripheral wall 25*a* of the annular operation chamber 5, an outer peripheral side sliding surface 51 making hermetic area-contact with the outer peripheral wall 25*b* of the annular operation chamber 5, and two sidewalls 52 positioned in planes containing the axis of the output shaft 1. The first reciprocating partitioning member 7 has at the forefront end a forefront sliding surface 53 making hermetic area-contact with the annular wall 26 on the rotor 2 side of the annular operation chamber 5, a first sliding surface 58 capable of making hermetic area-contact with the first inclined surface 41 of the arc-shaped partitioning member 6, and a second sliding surface 59 capable of making hermetic area-contact with the second inclined surface 43 of the arc-shaped partitioning member 6. The first reciprocating partitioning member 7 is made of a metal material having excellent solid lubricating property such as nodular graphite cast iron; however, it can be made of other metal materials.

The first sliding surface 58 has the same circumferential inclination as the first inclined surface 41 (the circumferential inclination is linearly decreased in the radially outward direction). The second sliding surface 59 has the same circumferential inclination as the second inclined surface 43 (the circumferential inclination is linearly decreased in the radially outward direction).

Seal-installation grooves to which lubricating oil is supplied and sealing members 60, 61 installed in the seal-installation grooves are provided near either end of the inner and outer peripheral side sliding surfaces 50, 51. The sealing members 60, 61 are biased toward their advanced positions by lubricating oil pressure. The forefront sliding surface 53 has a leading end and a trailing end on lines orthogonal to the axis of the output shaft 1. Seal-installation grooves to which lubricating oil is supplied and sealing members 62 movably installed in the sealing-installation grooves are provided near either end of the forefront sliding surface 53. The sealing members 62 are biased toward their advanced positions by lubricating oil pressure. Sealing members 63, 64 are installed in seal-installation grooves formed in the first and second sliding surfaces 58, 59 and to which lubricating oil is supplied. The sealing members 63, 64 are biased toward their advanced positions by lubricating oil pressure.

The first reciprocating partitioning member 7 has an oil passage (not shown) in the wall, to which lubricating oil is supplied from an oil passage (not shown) in the wall of the housing 4. Then, the lubricating oil is supplied to the seal-installation grooves. A structure for preventing the sealing members 60 to 64 from coming off the seal-installation grooves or a structure for biasing the sealing members 60 to 64 using plate springs installed in the seal-installation grooves can be utilized as appropriate.

As shown in FIGS. 2, 4, 5, 7, the second reciprocating partitioning member 8 is smaller than the first reciprocating partitioning member 7. However, the second reciprocating partitioning member 8 has the basically same structure as the first reciprocating partitioning member 7 and, therefore, its detailed explanation is omitted. The second reciprocating partitioning member 8 is hermetically and slidably installed in a guide hole 48 of the housing 4. The second reciprocating partitioning member 8 has an inner peripheral side sliding surface, an outer peripheral side sliding surface, two sidewalls, a forefront sliding surface, a first sliding surface, a second sliding surface, and sealing members, as with the first reciprocating partitioning member 7.

The first gas spring 9 for biasing the first reciprocating partitioning member 7 toward its advanced position is described hereafter. As shown in FIG. 6, seal-installation grooves to which lubricating oil is supplied are formed in the inner wall of the guide hole 47 for guiding the first reciprocating partitioning member 7 and, for example, four sealing members 65 are movably installed in the seal-installation grooves.

In order to reduce the weight of the first reciprocating partitioning member 7 as much as possible, the first reciprocating partitioning member 7 has a rectangular hole 66 formed from the opposite end to the rotor 2. The first gas spring 9 has a case 67 fixed to the housing 4, a plenum chamber 68 within the case 67, a guide case 69 formed integrally with the case 67 and partially and relatively slidably inserted in the rectangular hole 66, and two rods 71 hermetically and slidably installed in two rod holes 70 of the guide case 69.

The plenum chamber 68 is filled with, for example, nitrogen gas pressurized to 4.0 to 7.0 MPa. The two rods 71 receive the nitrogen gas pressure in the plenum chamber 68, whereby their tips abut against the bottom wall of the rectangular hole 66 and strongly bias the first reciprocating partitioning member 7 toward its advanced position. The first gas spring 9 is used to bias the first reciprocating partitioning member 7 toward its advanced position against pushing force (a force parallel to the axis of the output shaft 1) applied to the first reciprocating partitioning member 7 by fuel-air mixture gas pressure or combustion gas pressure. Therefore, the nitrogen gas pressure is properly determined based on the pushing force and the diameter and number of the rods 71. The structure and shape of the plenum chamber 68 is not restricted to what is shown in the figure. However, it is desirable that the plenum chamber 68 has a capacity as large as possible so that nitrogen gas pressure fluctuation is minimized while the two rods 71 reciprocate. The case 67 is constituted to allow the first reciprocating partitioning member 7 to be retracted to its retracted position shown by the broken lines in FIG. 6. The guide case 69 is chamfered to form four breathing holes 72 (see FIG. 11) between the inner surface of the rectangular hole 66 and the guide case 69. Multiple metal or non-metal sealing members 73 are installed in the rods 71.

The rectangular hole 66 can be shallower than shown in the figure or even omitted so that one or multiple rods 71 abut against the end of the first reciprocating partitioning member 7. Alternatively, gas spring pressure can directly be applied to the first reciprocating partitioning member 7. In place of the first gas spring 9, a compression spring or a hydraulic cylinder coupled to an accumulator can be used to bias the first reciprocating partitioning member 7 toward its advanced position. Further alternatively, a cam mechanism in synchronism with the output shaft 1 can be used to reciprocate the first reciprocating partitioning member 7.

Figure 7:
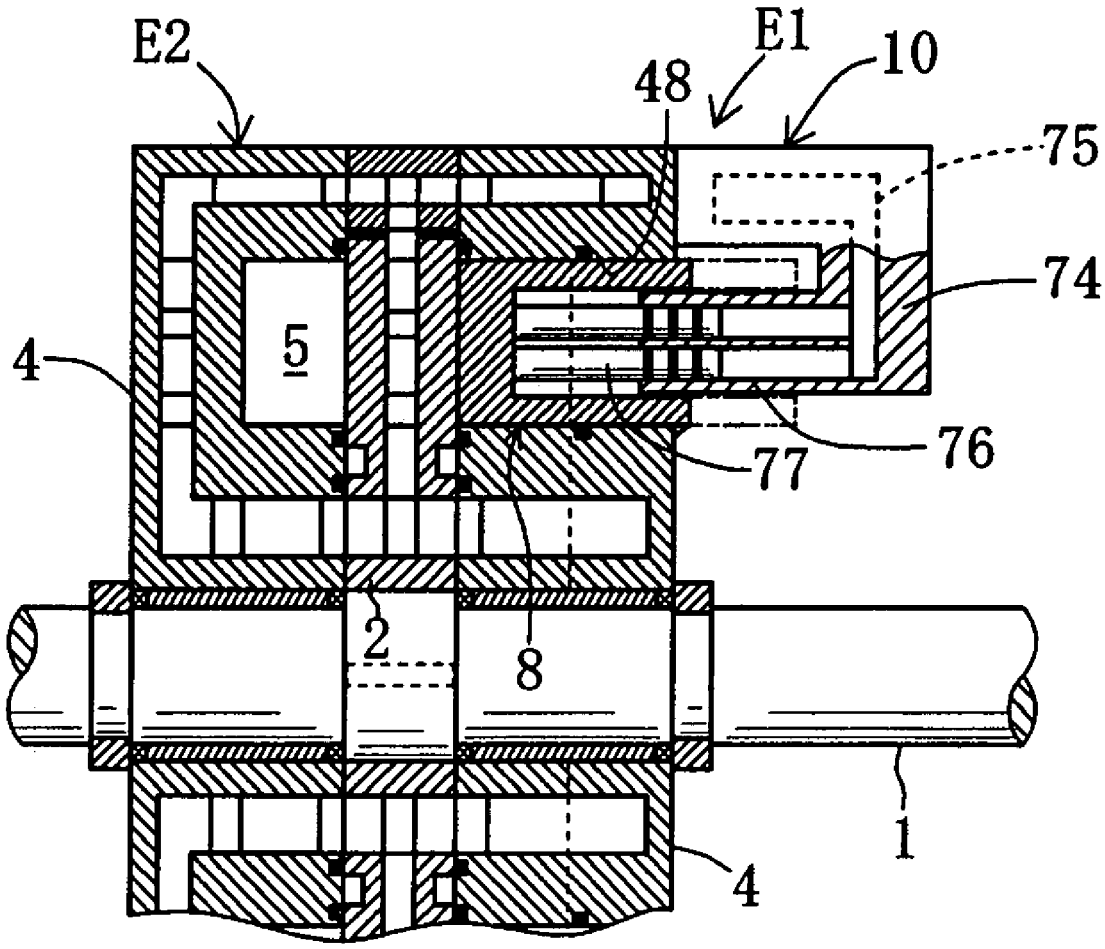
[FIG. 7] A cross-sectional view at the line VII-VII in FIG. 1.

As shown in FIG. 7, the second gas spring 10 for biasing the second reciprocating partitioning member 8 toward its advanced position is slightly smaller than the first gas spring 9. However, it has the same structure as the first gas spring 9 and its detailed explanation is omitted. The second gas spring 10 has a case 74, a plenum chamber 75 within the case 74, a guide case 76 partially inserted in a rectangular hole of the second reciprocating partitioning member 8, and two rods 77, as with the first gas spring 9.

The intake port 11, exhaust port 12, intake operation chamber, compression operation chamber, combustion operation chamber, and exhaust operation chamber are described hereafter. As shown in FIG. 2, the intake port 11 is formed near the second reciprocating partitioning member 8 in the circumferential wall of the housing 4 at the leading side than the second reciprocating partitioning member 8 and the exhaust port 12 is formed near the second reciprocating partitioning member 8 in the circumferential wall of the housing 4 at the trailing side than the second reciprocating partitioning member 8. The ports 11, 12 can be formed in the sidewall of the housing 4.

As shown in FIGS. 17 to 26, when the arc-shaped partitioning member 6 is between the intake port 11 and the first reciprocating partitioning member 7, the intake operation chamber 80 (int) is formed between the second reciprocating partitioning member 8 and the arc-shaped partitioning member 6, the compression operation chamber 81 (cmp) is formed between the arc-shaped partitioning member 6 and the first reciprocating partitioning member 7, and the exhaust operation chamber 83 (exh) is formed between the first reciprocating partitioning member 7 and the second reciprocating partitioning member 8 in the annular operation chamber 5. When the arc-shaped partitioning member 6 is between the first reciprocating partitioning member 7 and the exhaust port 12, the combustion operation chamber 82 (com) is formed between the first reciprocating partitioning member 7 and the arc-shaped partitioning member 6 and the exhaust operation chamber 83 (exh) is formed between the arc-shaped partitioning member 6 and the second reciprocating partitioning member 8 in the annular operation chamber 5.

As shown in FIG. 2, the housing 4 is provided with a fuel injector 14 as a fuel supply means for injecting fuel into the compressed intake air within the compression operation chamber 81. However, in place of the fuel injector 14, a fuel injector for injecting fuel into the auxiliary combustion chamber 13 can be provided. Furthermore, a fuel injector 14A for additionally injecting fuel into the combustion operation chamber 82 can be provided in addition to the fuel injector 14 or a fuel injector for injecting fuel into the auxiliary combustion chamber 13.

The auxiliary combustion chamber 13 and the surrounding structure is described hereafter. As shown in FIGS. 2, 6, and 14 to 16, the auxiliary combustion chamber 13 is formed in the wall of the housing 4 on the output shaft 1 side than the inner peripheral wall 25*a* at the circumferential position corresponding to the first reciprocating partitioning member 7. In this embodiment, the auxiliary chamber 13 is spherical. An intake passage 91 connecting the compression operation chamber 81 to the auxiliary combustion chamber 13 is formed in the housing 4 to introduce compressed fuel-air mixture within the compression operation chamber 81 into the auxiliary combustion chamber 13. An outlet passage 92 is formed in the housing 4 to discharge combustion gas within the auxiliary combustion chamber 13 into the combustion operation chamber 82. The capacity of the auxiliary combustion chamber 13 is determined in relation to the capacity of the intake operation chamber 80 so that it is filled with fuel-air mixture of a predetermined compression ratio (for example, 14 to 16 in the case of an ignition plug engine as in this embodiment). The capacity of the intake operation chamber 80 is determined in consideration of the volume of compressed fuel-air mixture remaining in the inlet passage 91. The auxiliary combustion chamber 13 can be formed on the outer side than the outer peripheral wall 25*b*.

A first on-off valve 15 for opening/closing the inlet passage 91 at the downstream end and a second on-off valve 16 for opening/closing the outlet passage 92 at the upstream end. The inlet passage 91 is formed so as to have a minimized capacity. The inlet passage 91 has at the upstream end a suction port 91*a* that is open to the annular operation chamber 5 on the inner peripheral wall 25*a* near the trailing end of the first reciprocating partitioning member 7. Following the suction port 91*a*, the inlet passage 91 has a curved portion through the wall, which is open to the auxiliary combustion chamber 13 at the downstream end, where it is closed/opened by the first on-off valve 15. The first on-off valve 15 of this embodiment is a poppet valve opened inward to the auxiliary combustion chamber 13.

The outlet passage 92 is open to the auxiliary combustion chamber 13 at the upstream end, where it is closed/opened by the second on-off valve 16. Following the upstream end opening, the outlet passage 92 has a curved portion, which ends with a blow-off port 92*a* that is open to the annular operation chamber 5 on the inner peripheral wall 25*a* near the leading end of the first reciprocating partitioning member 7. The second on-off valve 16 of this embodiment is a poppet valve opened outward from the auxiliary combustion chamber 13. However, the second on-off valve 16 can be a poppet valve opened inward to the auxiliary combustion chamber 13 as is the first on-off valve 15. The first and second on-off valves 15, 16 are given by way of example and various valve structures can be used.

Figure 14:
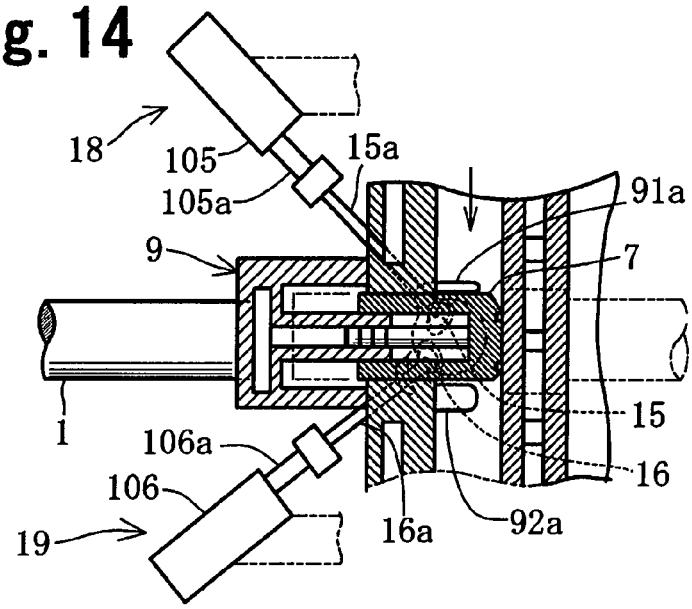
[FIG. 14] A circumferential cross-sectional view of the core part including the auxiliary combustion chamber, inlet and outlet passages, and first and second on-off valves.
Figure 15:
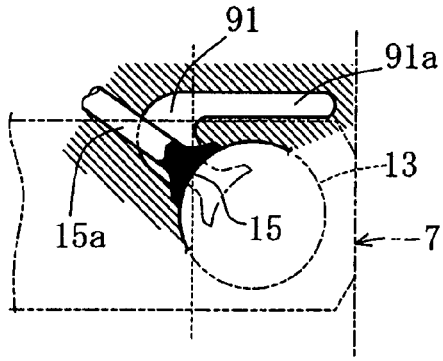
[FIG. 15] A cross-sectional view of the core part of the inlet passage and first on-off valve.
Figure 16:
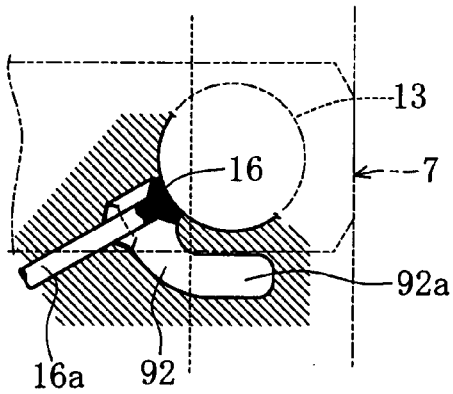
[FIG. 16] A cross-sectional view of the core part of the outlet passage and second on-off valve.
Figure 17:
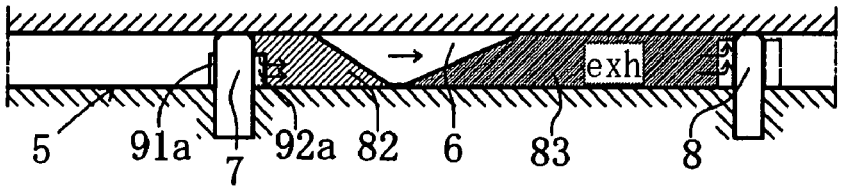
[FIG. 17] An illustration for explaining the operation of the rotary engine.
Figure 18:
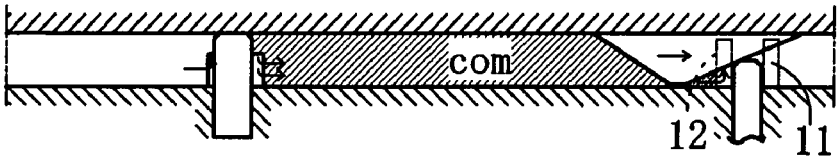
[FIG. 18] An illustration for explaining the operation of the rotary engine.
Figure 19:
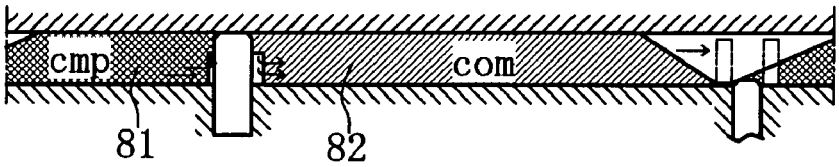
[FIG. 19] An illustration for explaining the operation of the rotary engine.

Valve-driving mechanisms 18, 19 for driving the first and second on-off valves 15, 16 are described hereafter. As shown in FIG. 14, the first on-off valve 15 has a valve shaft 15*a* extending obliquely upward through the wall of the housing 4 and the second on-off valve 16 has a valve shaft 16*a* extending obliquely downward through the wall of the housing 4. In order to introduce the first and second on-off valves 15 and 16, a part of the auxiliary combustion chamber 13 and the surrounding wall of the housing 4 are constituted by divided parts and the divided parts are fixed to the housing 4 by bolts and pins as appropriate.

For example, a shaft motor 105 capable of high speed operation is provided as an actuator for driving the valve shaft 15*a*. The shaft motor 105 has an output member 105*a* coupled to the valve shaft 15*a*. The first on-off valve 15 is opened/closed by the shaft motor 105 in synchronism with the rotation of the output shaft 1. Similarly, for example, a shaft motor 106 capable of high speed operation is provided as an actuator for driving the valve shaft 16*a*. The shaft motor 106 has an output member 106*a* coupled to the valve shaft 16*a*. The second on-off valve 16 is opened/closed by the shaft motor 106 in synchronism with the rotation of the output shaft 1. The two shaft motors 105 and 106 are controlled by a control unit (not shown) for controlling the engine.

The above valve-driving mechanisms 18, 19 are given by way of example and various valve-driving mechanisms can be used.

If the shape of the auxiliary chamber 13 allows, the valve shafts 15*a*, 16*a* can be placed in parallel to the axis of the output shaft 1. In such a case, the valve shafts 15*a*, 16*b* can directly be driven by cam members provided to the output shaft 1. Alternatively, the first and second on-off valves 15*a*, 16*b* can be driven by first and second cam members driven by two cam shafts linked to the output shaft 1. Further alternatively, the first and second on-off valves 15, 16 can be driven by first and second cam members driven by two electric motors rotating in synchronism with the output shaft 1. Further alternatively, the first and second on-off valves 15, 16 can be driven individually directly by two solenoid actuators.

Actuations of the above described rotary engine E are described hereafter.

FIGS. 17 to 26 are illustrations showing the intake, compression, combustion, and exhaust strokes of the rotary engine E1. They are developed views of the full circle of the annular operation chamber 5 seen from radially outside. These figures show the four strokes of the right side rotary engine E1. The four strokes of the left side rotary engine E2 are delayed in relation to the four strokes of the right side engine E1 by a rotation angle of 180 degrees of the output shaft 1.

The figures show the arc-shaped partitioning member 6, first and second reciprocating partitioning members 7, 8, suction port 91*a*, blow-off port 92*a*, intake port 11, and exhaust port 12. The compression stroke end timing shown in FIG. 23 corresponds to "the compression upper dead point." In the figures, "int" represents the intake stroke; "cmp," the compression stroke; "com," the combustion stroke; and "exh," the exhaust stroke. The actuations of the engine proceeds from the FIG. 17 to FIG. 26 in sequence and returns from FIG. 26 to FIG. 17 in sequence. Fuel is injected by the fuel injector 14 in a proper timing during the period from FIG. 20 to FIG. 22.

Figure 20:
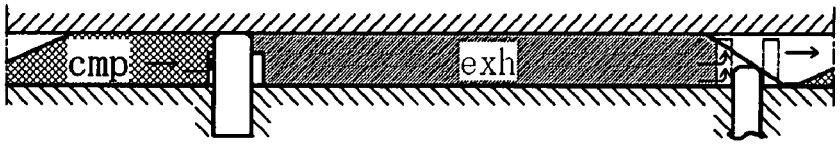
[FIG. 20] An illustration for explaining the operation of the rotary engine.
Figure 21:
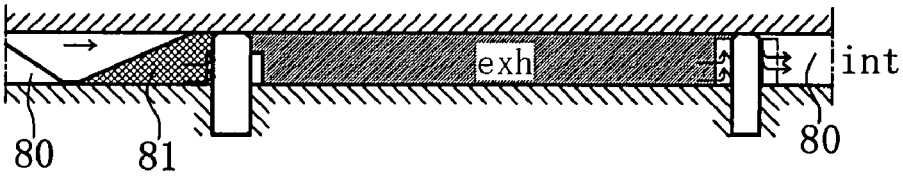
[FIG. 21] An illustration for explaining the operation of the rotary engine.
Figure 22:
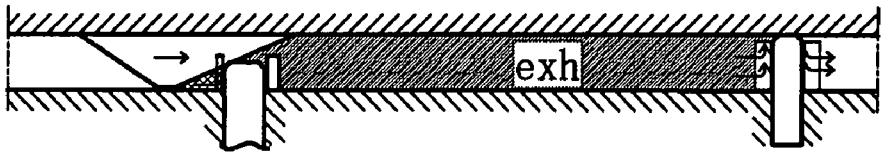
[FIG. 22] An illustration for explaining the operation of the rotary engine.
Figure 23:
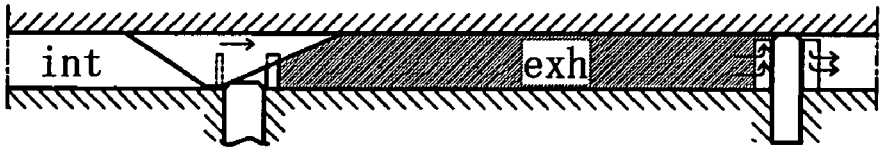
[FIG. 23] An illustration for explaining the operation of the rotary engine.
Figure 24:
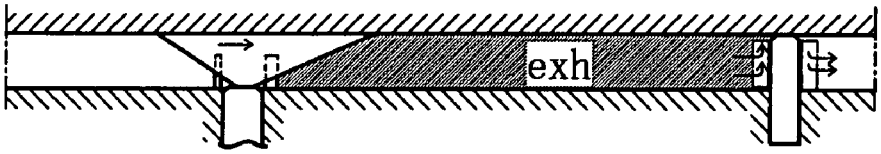
[FIG. 24] An illustration for explaining the operation of the rotary engine.
Figure 25:
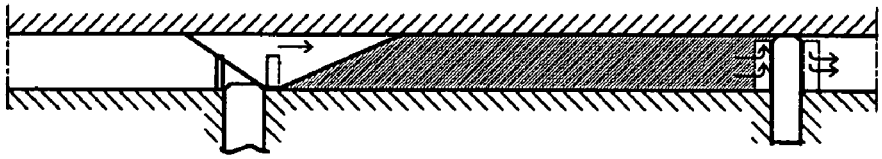
[FIG. 25] An illustration for explaining the operation of the rotary engine.
Figure 26:
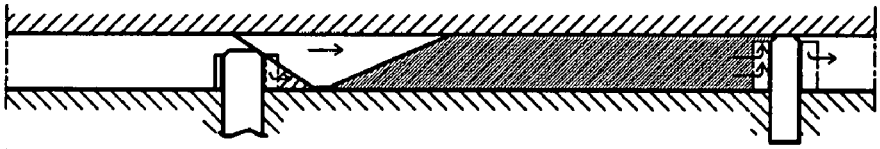
[FIG. 26] An illustration for explaining the operation of the rotary engine.

The first on-off valve 15 is closed at the moment of the compression upper dead point shown in FIG. 23 and opened in a proper timing near the timing of FIG. 20. The second on-off valve 16 is opened in a proper timing during the period between FIGS. 25, 26 and closed nearly at the same timing as the first on-off valve 15 is opened. Fuel-air mixture within the auxiliary combustion chamber 13 is ignited by a spark plug 17, for example, nearly at the same timing as the compression upper dead point.

As seen from the actuations shown in FIGS. 17 to 26, air is inhaled from the intake port 11 as the rotor 2 rotates, the intake air is compressed by the arc-shaped partitioning member 6 rotating with the rotor 2, fuel is injected by the fuel injector 14 into the compressed air within the compression operation chamber 81, the fuel-air mixture is introduced into the auxiliary combustion chamber 13 and ignited by the spark plug 17 after the first and second on-off valves 15, 16 are closed, the combustion gas is ejected through the blow-off port 92*a* into the combustion operation chamber 82 as the second on-off valve 16 is opened, and the combustion gas pressure is applied to the arc-shaped partitioning member 6 during the combustion stroke, thereby generating torque for rotating (driving) the output shaft 1. Exhaustive gas is exhausted through the exhaust port 12. Here, the area S shown in FIG. 3 corresponds to a pressure-receiving area with which the arch-shaped partitioning member 6 receives the combustion gas pressure.

Operation and advantages of the rotary engine E is described hereafter.

The inner peripheral side sliding surface 6*a* of the arc-shaped partitioning member 6 makes hermetic area-contact with the inner peripheral wall 25*a* of the annular operation chamber 5, the outer peripheral side sliding surface 6*b* makes hermetic area-contact with the outer peripheral wall 25*b* of the annular operation chamber 5, and the forefront sliding surface 42 makes hermetic area-contact with the housing side annular wall 25*c* of the annular operation chamber 5. Therefore, the arc-shaped partitioning member 6 transversely and hermetically partitions the annular operation chamber 5.

The first and second reciprocating partitioning members 7, 8 hermetically partition the annular operation chamber 5 when they are at their advanced positions. When the arc-shaped partitioning member 6 rotates with the rotor 2, the first and second reciprocating partitioning members 7, 8 make hermetic contact with the first inclined surface 41, forefront sliding surface 42, and second inclined surface 43 of the arch-shaped partitioning member 6 in sequence and move from their advanced positions to their retracted positions. Then, they return to their advanced positions after the arc-shaped partitioning member 6 passes them.

The forefront sliding surfaces 53 of the first and second reciprocating partitioning members 7, 8 make hermetic area-contact with the part of the annular wall 26 of the rotor 2 that is on a plane orthogonal to the axis. The inner peripheral side sliding surfaces 50 of the first and second reciprocal partitioning members 7, 8 make hermetic area-contact with the inner peripheral wall 25*a* of the annular operation chamber 5 and the outer peripheral side sliding surfaces 51 make hermetic area-contact with the outer peripheral wall 25*b*. Consequently, the first and second reciprocating partitioning members 7, 8 hermetically and transversely partition the annular operation chamber 5. The first and second reciprocating partitioning members 7, 8 do not make relative movement to the housing 4 in the rotation direction, which is advantageous for hermetic sealing. A mechanism for inhibiting relative movement of the first and second reciprocating partitioning members 7, 8 to the housing 4 in the rotation direction can be provided (see an engaging guide mechanism 110, 110A described later).

In the rotary engines E1 and E2, the annular operation chamber 5 is formed by the larger-diameter portion of at least one of sidewall portions of the rotor 2 having a radius of 0.5R and larger (R is the radius of the rotor 2) and the housing 4. In this way, the side space of the rotor 3 in the axial direction is effectively used to form the annular operation chamber 5, eliminating a member largely protruding outward from the outer periphery of the rotor 2 and reducing the total height and width of the engine. The arc-shaped partitioning member 6 and first and second reciprocating partitioning members 7, 8 all make hermetic area-contact with the walls of the annular operation chamber 5, which is advantageous for ensuring sealing and lubricating properties and durability.

The annular operation chamber 5 faces the larger-diameter portion of the rotor 2. Therefore, the rotation radius from the axis of the output shaft 1 to the pressuring/pressured member 6 receiving the combustion gas pressure (which corresponds to the crank radius) can be significantly larger than the reciprocating engine crank radius of the same cylinder capacity. Furthermore, the combustion gas pressure is converted to output torque via the above larger rotation radius, thereby significantly improving the conversion efficiency from combustion gas pressure to output (torque, horsepower) and achieving an internal combustion engine having high fuel economical efficiency.

The rotor engine E1 has one arc-shaped partitioning member 6 on one side of the rotor 2 and the first and second reciprocating partitioning members 7, 8 on the housing 4. One combustion stroke is realized by one rotation of the output shaft 1 and, therefore, the cylinder capacity can be reduced to half the cylinder capacity of a four-cycle engine of the same output power, thereby downsizing the engine. For example, when the annular operation chamber 5 has an inner radius of 17 cm, an outer radius of 23 cm, and a thickness of 4 cm in the axial direction, and the intake operation chamber 80 has an arc length of 105 degrees in the circumferential direction, the intake operation chamber 80 has a capacity of approximately 750 cc, which corresponds to a four-cycle engine having a cylinder capacity of 1500 cc. Furthermore, it corresponds to a four-cycle engine having a cylinder capacity of 3000 cc since two sets of the annular operation chamber 5 are provided on either side of the rotor 2. However, because of compressed fuel-air mixture remaining in the inlet passage 91, the inner and outer radiuses may be approximately 18 cm and 24 cm, respectively, in practice.

In addition, the combustion stroke can span 180 to 200 degrees or even larger of the output shaft. The combustion stroke can be made larger than that of a four-cycle engine for improved combustion performance. The annular operation chamber 5 is formed on either side of the rotor 2 and the rotor 2 is shared by two sets of engine E1 and E2. This is advantageous for producing a downsized, but higher output engine and for lower engine rotation speeds.

A partially modified embodiment of the above rotary engine E is described hereafter.

Embodiment 2

Figure 27:
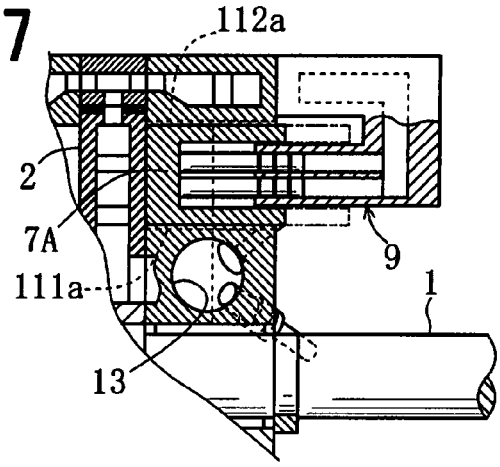
[FIG. 27] An illustration equivalent to FIG. 6 and showing the first reciprocating partitioning member of Embodiment 2.
Figure 28:
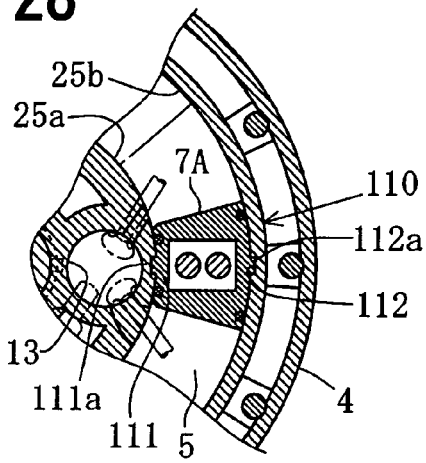
[FIG. 28] A cross-sectional view of the first reciprocating partitioning member and the surrounding structure of Embodiment 2.

As shown in FIGS. 27 and 28, compressed fuel-air mixture gas pressure is applied to the first reciprocating partitioning member 7A in the circumferential direction within the compression operation chamber and combustion gas pressure is applied to the first reciprocating partitioning member, 7A in the circumferential direction within the combustion operation chamber. Then, an engaging guide mechanism 110 for inhibiting the first reciprocating partitioning member 7A from moving in the circumferential direction and allowing it to move in parallel to the axis of the output shaft 1 is provided. The engaging guide mechanism 110 comprises engaging protrusions 111, 112 and engaging grooves 111*a*, 112*a* with which the engaging protrusions 111, 112 engage with no jolt in the circumferential direction, but slidably in the axial direction.

The engaging protrusions 111, 112 protrude from the inner and outer peripheral side sliding surfaces 50, 51 of the first reciprocating partitioning member 7 at the center in the width direction, respectively, and are parallel to the axis of the output shaft 1. The engaging grooves 111*a*, 112*a* are recessed in the inner and outer peripheral walls 25*a*, 25*b* of the annular operation chamber 5, respectively. Gas pressure applied to the first reciprocating partitioning member 7A in the circumferential direction is sustained by the engaging guide mechanism 110, whereby the load on the first reciprocating partitioning member 7A is alleviated and elastic deformation of the first reciprocating partitioning member 7A in the circumferential direction can be prevented. Consequently, the first reciprocating partitioning member 7A can smoothly reciprocate and be reduced in size. Here, the engaging protrusion and engaging groove on one side (on the inner or outer side) can be eliminated. Key members can be used in place of the engaging protrusions 111, 112.

Figure 29:
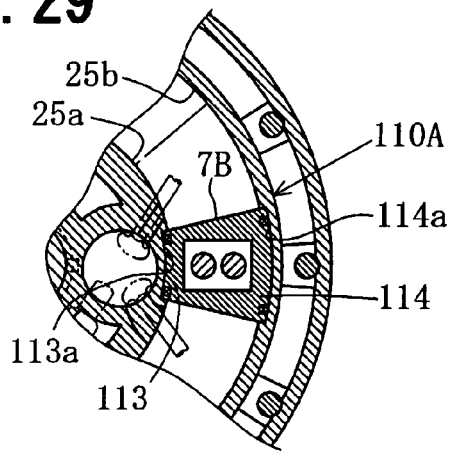
[FIG. 29] An illustration equivalent to FIG. 28 and showing another first reciprocating partitioning member of Embodiment 2.

An engaging guide mechanism 110A shown in FIG. 29 is used for the same purpose as the engaging guide mechanism 110. The engaging guide mechanism 110A comprises engaging protrusions 113, 114 extending over the entire widths of the inner and outer peripheral side surfaces of the first reciprocating partitioning member 7B in the circumferential direction and engaging grooves 113*a*, 114*a* formed on the inner and outer peripheral walls 25*a* and 25*b* of the annular operation chamber 5 and with which the engaging protrusions 113, 114 engage with no jolt in the circumferential direction, but slidably in the axial direction. Here, the engaging protrusion and engaging groove on one side (on the inner or outer side) can be omitted. In this structure, the inner and outer peripheral walls 25*a*, 25*b* of the annular operation chamber 5 are mostly cylindrical. The same engaging guide mechanism as the engaging guide mechanism 110 or 110A can be provided to the second reciprocating partitioning member 8.

Embodiment 3

Figure 30:
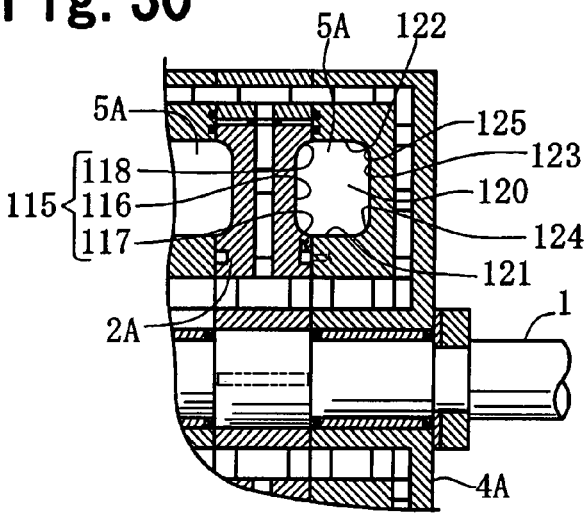
[FIG. 30] A vertical cross-sectional front view of the core part of the annular operation chamber of Embodiment 3.
Figure 31:
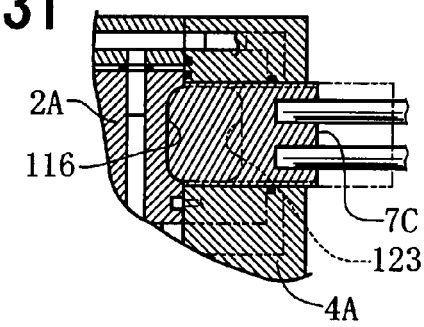
[FIG. 31] A radial cross-sectional view of the first reciprocating partitioning member and the surrounding structure of Embodiment 3.
Figure 32:
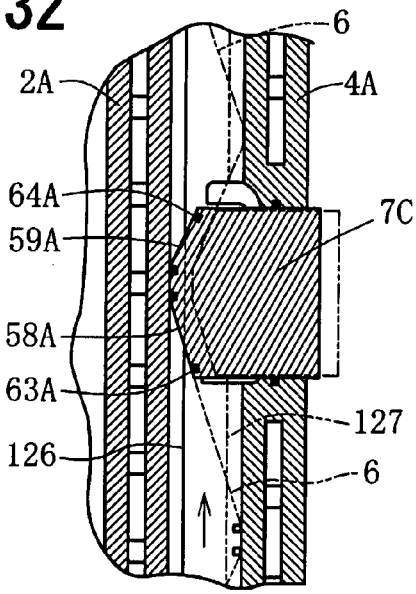
[FIG. 32] A circumferential cross-sectional view of the first reciprocating partitioning member and the surrounding structure of Embodiment 3.

As in the above embodiment, when the annular operation chamber 5A has a rectangular half-section, the combustibility of fuel-air mixture may be lower in the corners of the annular operation chamber 5A. Then, as shown in FIGS. 30 to 32, the annular operation chamber 5A has a rectangular half-section with rounded corners in a plane containing the axis of the output shaft 1. This annular operation chamber 5A is constituted by a shallow groove 115 formed in the rotor 2A and a deep groove 120 formed in the housing 4A.

The shallow groove 115 has a first annular wall 116 on a plane orthogonal to the axis of the output shaft 1 and inner and outer corner walls 117, 118 that is on the inner peripheral side and on the outer peripheral side of the first annular wall 116. The deep groove 120 has an inner cylindrical wall 121, an outer cylindrical wall 122, a second annular wall 123 on a plane orthogonal to the axis of the output shaft 1, and inner and outer corner walls 124, 125 that are on the inner peripheral side and on the outer peripheral side of the second annular wall 123. As shown in FIGS. 31 and 32, a first reciprocating partitioning member 7C has an increased width in the circumferential direction. The same engaging guide mechanism as the engaging guide mechanism 110A is provided for the first reciprocating partitioning member 7C. The first reciprocating partitioning member 7C has at the forefront end a cross section partitioning the shallow groove 115. The first and second contact surfaces 58A, 59A have increased widths. The first and second contact surfaces 58A, 59A are provided with seal-installation grooves and sealing members 63A, 64A extending from the inner cylindrical surface 121 to the outer cylindrical surface 122 of the deep groove 120.

The solid line 126 represents the border between the rotor 2A and the housing 4A and the broken line 127 represents the ends of the rounded corner walls 124, 125. The inner peripheral wall of the annular operation chamber 5A is mostly cylindrical and the outer peripheral wall is mostly cylindrical. Instead of using the first and second contact surfaces 58A, 59A having increased widths, shallow recesses making hermetic contact with the forefront part of the first reciprocating partitioning member 7C can be formed in the first and second inclined surfaces 41, 43.

Embodiment 4

Figure 33:
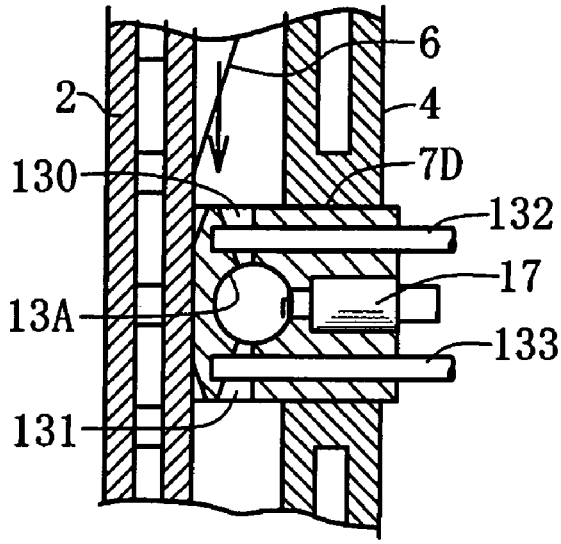
[FIG. 33] A circumferential cross-sectional view of the first reciprocating partitioning member and the surrounding structure of Embodiment 4.

As shown in FIG. 33, a first reciprocating partitioning member 7D is reciprocatively installed in the housing 4. An auxiliary combustion chamber 13A is formed in the first reciprocating partitioning member 7D. A flattened inlet passage 130 connecting the compression operation chamber 81 to the auxiliary combustion chamber 13A is formed in the training end wall of the first reciprocating partitioning member 7D. A flattened outlet passage 131 connecting the auxiliary combustion chamber 13A to the combustion operation chamber is formed in the leading end wall of the first reciprocating partitioning member 7D. A rotary valve 132 for opening/closing the flattened inlet passage 130 and a rotary valve 133 for opening/closing the flattened outlet passage 131 are rotatably installed in the first reciprocating partitioning member 7D. The rotary valves 132, 133 are each rotated by 90 degrees by an actuator (not shown) to open/close the inlet and outlet passages 130, 131, respectively, in synchronism with the rotation of the output shaft 1. Here, the spark plug 17 for igniting compressed fuel-air mixture in the auxiliary combustion chamber 13A is also provided. The inlet passage 130 is flattened and small in length, thereby having a smaller capacity, which is suitable for small-size rotary engines. The inlet and outlet passages 130, 131 can be opened/closed by shifting the rotary valves 132, 133 in their axial direction.

Embodiment 5

Figure 34:
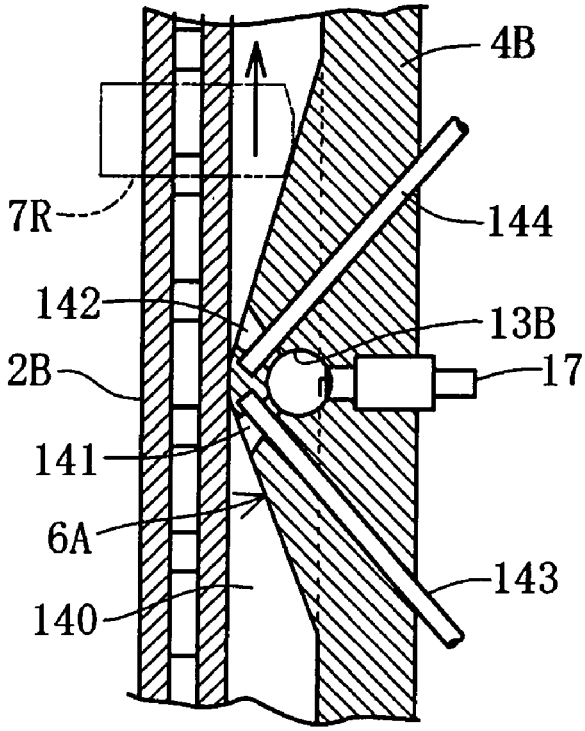
[FIG. 34] A circumferential cross-sectional view of the first reciprocating partitioning member and the surrounding structure of Embodiment 5.

A rotor 2B has an annular groove 140 that is a similar groove to the annular groove 25 constituting the annular operating chamber 5 and open on the side to a housing 4B. The rotor 2B is provided with a reciprocating partitioning member 7R as the pressuring/pressured member. As shown in FIG. 34, the housing 4B is integrally provided with one or multiple arc-shaped partitioning members 6A as the operation chamber partitioning member. An auxiliary combustion chamber 13B is formed in at least one of the arc-shaped partitioning members 6A. A flattened inlet passage 141 connecting the compression operation chamber to the auxiliary combustion chamber 13B is formed in the trailing end wall of the arc-shaped partitioning member 6A and a flattened outlet passage 142 connecting the auxiliary combustion chamber 13B to the combustion operation chamber is formed in the leading end wall of the arc-shaped partitioning member 6A.

A rotary valve 143 for opening/closing the inlet passage 141 and a rotary valve 144 for opening/closing the outlet passage 142 are rotatably installed in the arc-shaped partitioning member 6A. The rotary valves 143, 144 are each rotated by 90 degrees by an actuator (not shown) to open/close the inlet and outlet passages 141, 142, respectively, in synchronism with the rotation of the output shaft 1. Here, the spark plug 17 for igniting compressed fuel-air mixture in the auxiliary combustion chamber 13B is also provided. The inlet passage 141 is flattened and small in length, thereby having a smaller capacity, which is suitable for small-size rotary engines. The inlet and outlet passages 141, 142 can be opened/closed by shifting the rotary valves 143, 144 in their axial direction. A case or housing member for covering the exterior of the rotor 2B can be provided where necessary.

Embodiment 6

Figure 35:
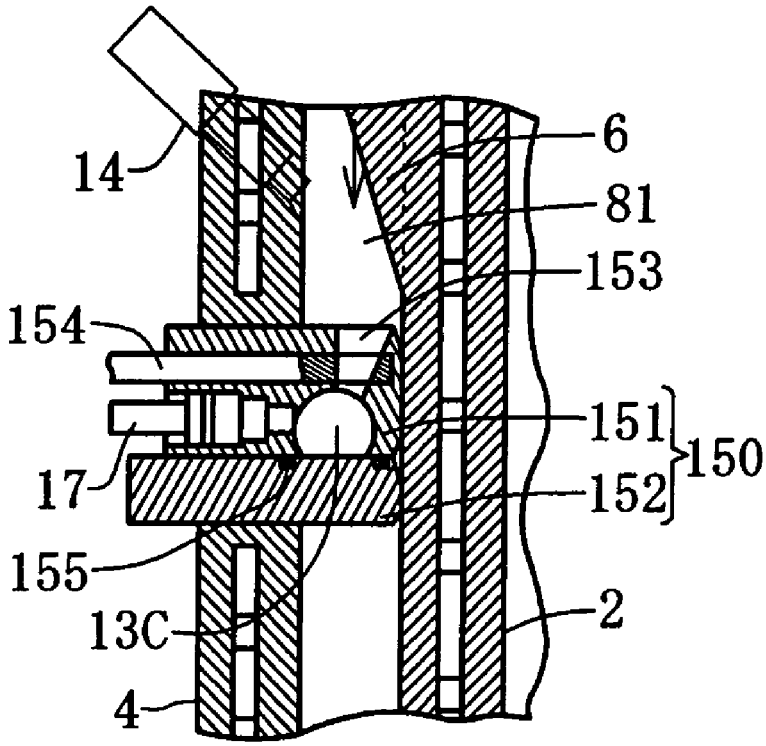
[FIG. 35] A circumferential cross-sectional view of the first reciprocating partitioning member and the surrounding structure of Embodiment 6.
Figure 36:
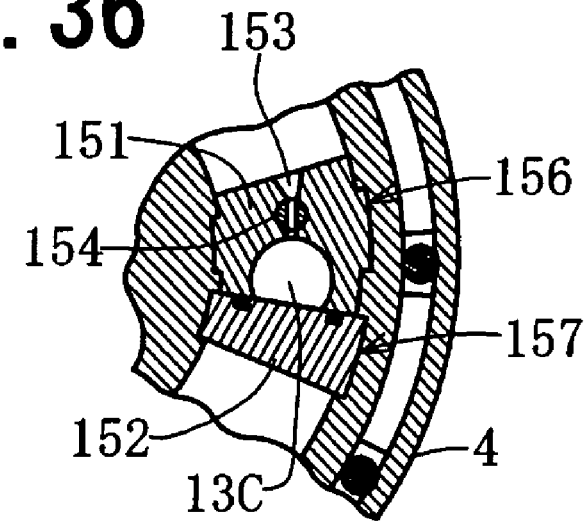
[FIG. 36] A cross-sectional view in the direction orthogonal to the axis of the first reciprocating partitioning member and the surrounding structure of Embodiment 6.
Figure 37:
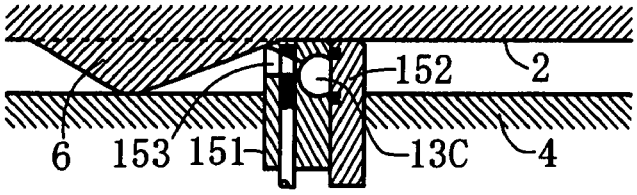
[FIG. 37] An illustration for explaining the operation of the first reciprocating partitioning member of Embodiment 6.
Figure 38:
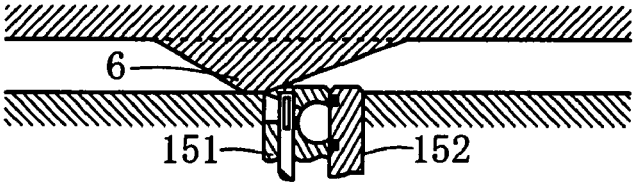
[FIG. 38] An illustration for explaining the operation of the first reciprocating partitioning member of Embodiment 6.
Figure 39:
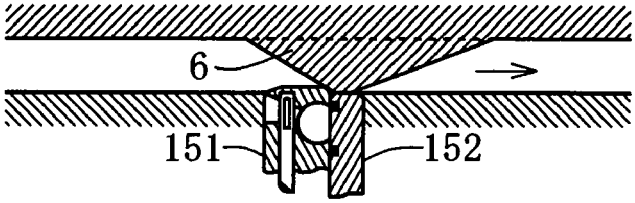
[FIG. 39] An illustration for explaining the operation of the first reciprocating partitioning member of Embodiment 6.
Figure 40:
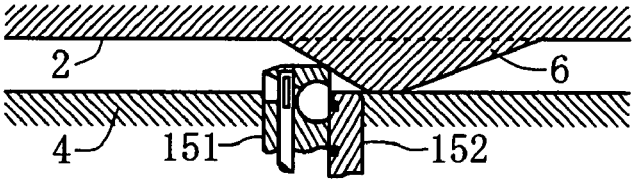
[FIG. 40] An illustration for explaining the operation of the first reciprocating partitioning member of Embodiment 6.
Figure 41:
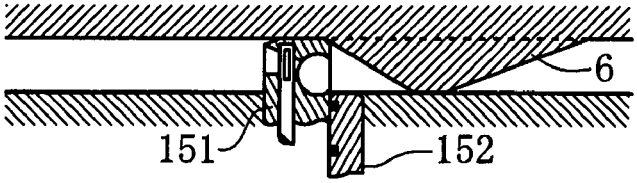
[FIG. 41] An illustration for explaining the operation of the first reciprocating partitioning member of Embodiment 6.

As shown in FIGS. 35 and 36, this rotary engine has a first reciprocating partitioning member 150 comprising first and second partitioning members 151, 152. Engaging guide mechanisms 156, 157 are provided for the first and second partitions 151, 152. An auxiliary combustion chamber 13C in the shape of a partially cut-off sphere is formed in the first partitioning member 151. The auxiliary combustion chamber 13C is open on the leading end of the first partitioning member 151. The second partitioning member 152 is pressed against the leading end of the first partitioning member 151 so as to close/open the opening of the auxiliary combustion chamber 13C.

A flattened inlet passage 153 for introducing compressed fuel-air mixture from the compression operation chamber 81 into the auxiliary combustion chamber 13C is formed. A rotary valve 154 for opening/closing the inlet passage 153 is installed in the first partitioning member 151. The rotary valve 154 is rotated by 90 degrees by an actuator (not shown) provided to the first partitioning member 151 to open/close the inlet passage 153. The first partitioning member 151 is also provided with the spark plug 17 for igniting fuel-air mixture in the auxiliary combustion chamber 13C and an annular sealing member 155 for sealing the outer periphery of the opening of the auxiliary combustion chamber 13C.

The first partitioning member 151 is biased toward its advanced position by a gas spring or a metal spring (not shown). The second partitioning member 152 reciprocates in synchronism with the rotation of the output shaft 1 by means of a cam mechanism (not shown) linked to the output shaft 1. FIGS. 37 to 41 show the operations of the first and second partitioning members 151, 152. Fuel-air mixture is introduced into the auxiliary combustion chamber 13C from the compression operation chamber in FIG. 37, reaches the compression dead point in FIG. 38, and is ignited using the spark plug 17 in FIG. 39. Then, combustion gas is ejected into the combustion operation chamber from the auxiliary combustion chamber 13C in FIGS. 40 and 41.

With the first reciprocating partitioning member 150, the inlet passage 153 can have a significantly small capacity and combustion gas is ejected into the combustion operation chamber from the auxiliary combustion chamber 13C, which is suitable for small-size engines.

The rotary valves can be eliminated. In such a case, the inlet passage 153 can be opened/closed by a third partitioning member similar to the second partitioning member 152, the third partitioning member being provided on the trailing end side of the first partitioning member 151 and reciprocated by a cam mechanism.

Embodiment 7

Figure 42:
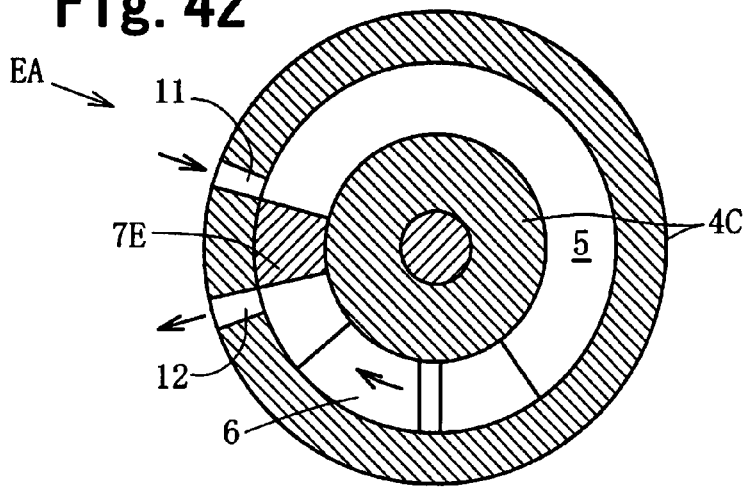
[FIG. 42] A schematic cross-sectional view of the rotary engine of Embodiment 7.

In a rotary engine EA shown in FIG. 42, the rotor 2 comprises as the pressuring/pressured member an arc-shaped partitioning member 6 partitioning the annular operation chamber 5 and the housing 4C is provided with a reciprocating partitioning member 7E as the operation chamber partitioning member and an auxiliary combustion chamber (not shown) corresponding to it. The second reciprocating partitioning member 8 is omitted. The housing 4C has an intake port 11 formed near the reciprocating partitioning member 7E at the leading side than the reciprocating partitioning member 7E and an exhaust port 12 formed near the reciprocating partitioning member 7E at the trailing side than the reciprocating partitioning member 7E. An intake valve (not shown) for opening/closing the intake port 11 and an exhaust valve (not shown) for opening/closing the exhaust port 12 are also provided.

In the rotary engine EA, the intake and exhaust valves are properly opened/closed in synchronism with the rotation of the output shaft 1, whereby every four rotations of the output shaft 1 result in two combustion strokes. When two sets of engine are provided on either side of the rotor, every four rotations of the output shaft 1 result in four combustion strokes. The combustion period spans over a rotation angle of 360 degrees of the output shaft 1. This sufficient combustion period significantly improves combustion performance.

Embodiment 8

Figure 43:
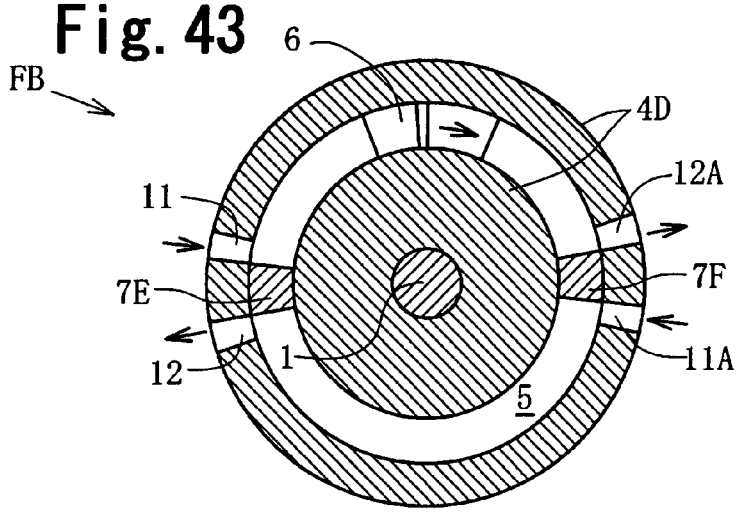
[FIG. 43] A schematic cross-sectional view of the rotary engine of Embodiment 8.

A rotary engine EB shown in FIG. 43 consists of the engine in FIG. 42 with the addition of a reciprocating partition 7F partitioning the annular operation chamber 5, an auxiliary combustion chamber (not shown) corresponding to it, an intake port 11A, an exhaust port 12A in a housing 4D at rotationally symmetrical positions in relation to the reciprocating partition 7E, intake port 11, and exhaust port 12 about the axis. An intake valve for opening/closing the intake port 11A and an exhaust valve for opening/closing the exhaust port 12A are also provided.

In the engine EB, two sets of intake and exhaust valves are properly opened/closed in synchronism with the rotation of the output shaft 1, whereby every two rotations of the output shaft 1 result in four combustion strokes. When two sets of engine are provided on either side of the rotor, every two rotations of the output shaft 1 result in eight combustion strokes.

Embodiment 9

Figure 44:
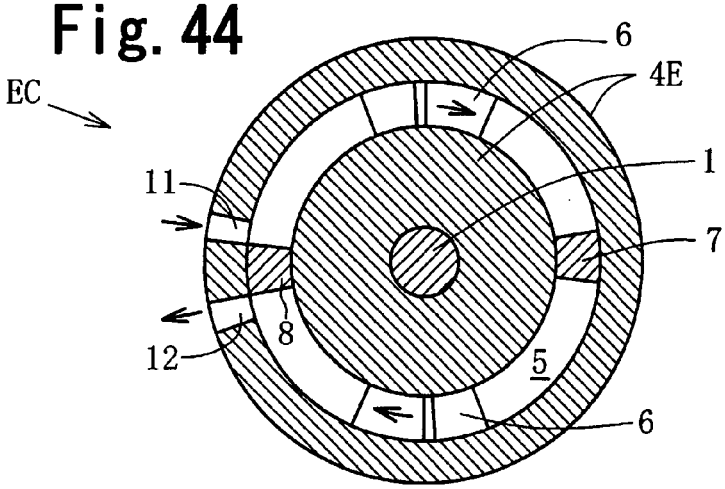
[FIG. 44] A schematic cross-sectional view of the rotary engine of Embodiment 9.

In a rotary engine EC shown in FIG. 44, a housing 4E is provided with first and second partitioning members 7, 8 partitioning the annular operation chamber 5 as in the rotary engine E and the rotor comprises as the pressuring/pressured member two arc-shaped partitioning members 6, 6 spaced by approximately 180 degrees in the rotor rotation direction. In the engine EC, two ignitions occur in every one rotation of the output shaft 1; a combustion stroke occurs for every 180-degree rotation of the output shaft 1. Therefore, the engine can be reduced in size, have a margin in the cylinder capacity, and be driven at lower speeds, thereby leading to improved combustion performance.

Embodiment 10

Figure 45:
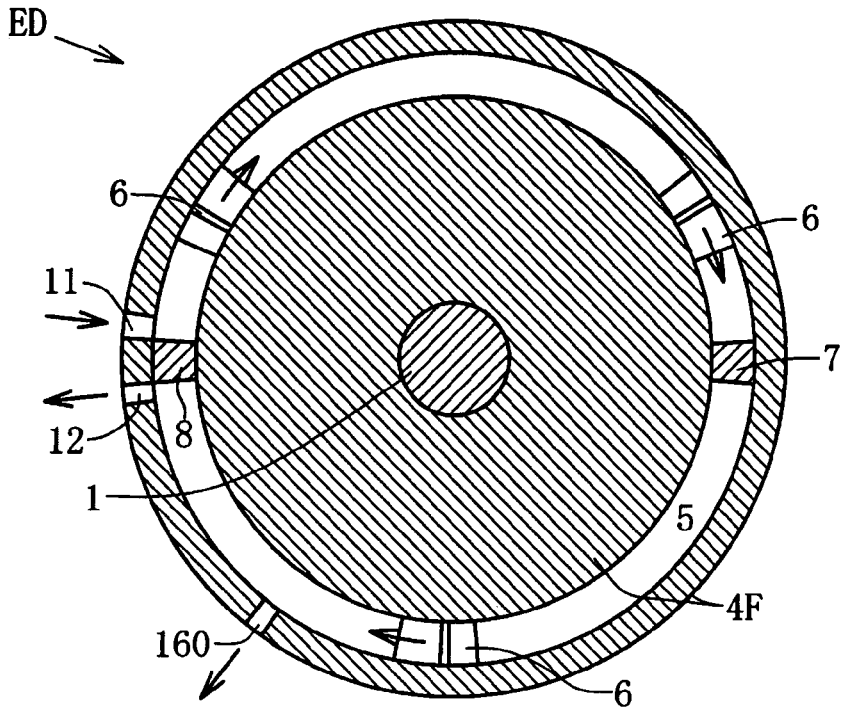
[FIG. 45] A schematic cross-sectional view of the rotary engine of Embodiment 10.

A rotary engine ED shown in FIG. 45 is suitable for medium- or large-size engines operating at lower speeds such as medium- or large-size marine engines. Similarly to the engine E, the engine ED has first and second reciprocating partitioning members 7, 8 installed in a housing 4F for partitioning the annular operation chamber 5. The housing 4F also has an additional exhaust port 160 at a position of approximately 120 degrees from the leading end of the first reciprocating partitioning member 7. An auxiliary combustion chamber (not shown) is also provided near the first reciprocating partitioning member 7.

The rotor comprises as the pressuring/pressured member three arc-shaped partitioning members 6, 6, 6 at trisected positions on the circumference. In the engine ED, three ignitions occur in every one rotation of the rotor. A combustion stroke occurs for every 120-degrees rotation of the output shaft 1. When two sets of engine are provided on either side of the rotor, a combustion stroke occurs for every 60 degree-rotation of the output shaft 1. Therefore, the engine can be reduced in size, have a margin in the cylinder capacity, and be driven at lower speeds, thereby leading to improved combustion performance.

Embodiment 11

Figure 46:
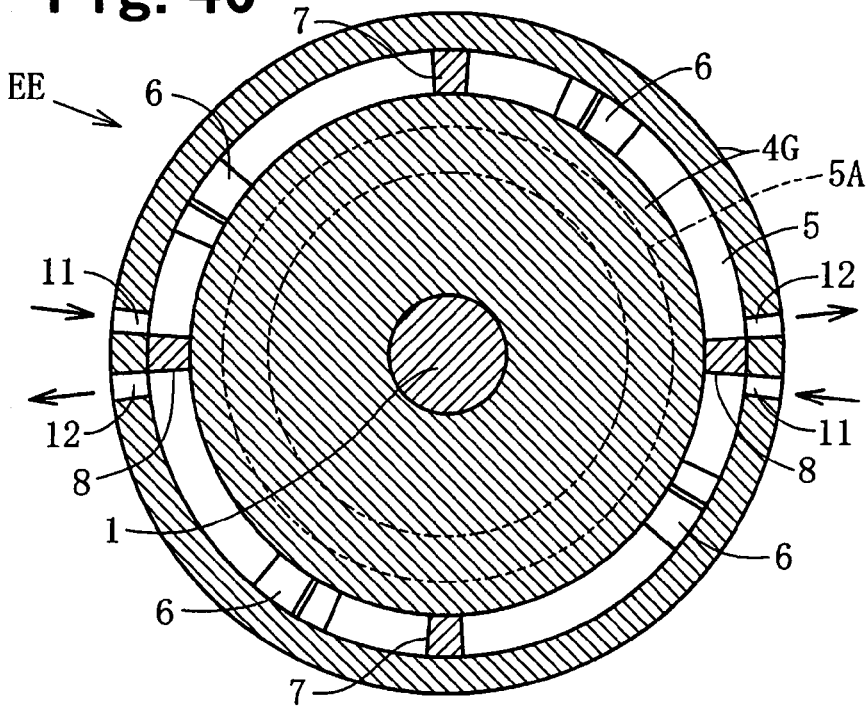
[FIG. 46] A schematic cross-sectional view of the rotary engine of Embodiment 11.

A rotary engine EE shown in FIG. 46 is suitable for medium- or large-size engines operating at lower speeds such as marine engines. A housing 4G is provided with as the partitioning member partitioning the annular operation chamber 5 four reciprocating partitioning members 7, 8 at quadricsected positions on the circumference. The rotor comprises as the pressuring/pressured member four arc-shaped partitioning members 6 at quadricsected positions on the circumference. Intake ports 11 are formed near the reciprocating partitioning member 8 at the leading sides in the rotation direction than the two reciprocating partitioning members 8 spaced by 180 degrees in the circumferential direction and exhaust ports 12 are formed near the reciprocating partitioning member 8 at the trailing sides in the rotation direction thereof. Auxiliary combustion chambers (not shown) are formed near the two reciprocating partitioning members 7.

In the engine EE, the two auxiliary combustion chambers are ignited for two combustion strokes in every 90-degree rotation of the output shaft 1. Therefore, every one rotation of the output shaft 1 results in eight combustion strokes. Consequently, the engine can be reduced in size.

As indicated by the broken lines, an annular operation chamber 5A can be formed inside the annular operation chamber 5. The annular operation chamber 5A can be provided with multiple reciprocating partitioning members, multiple arc-shaped partitioning members, multiple auxiliary combustion chambers, and two sets of intake and exhaust ports as with the outer annular operation chamber 5. In this way, another set of engine is additionally constituted for effective use of space in the rotor and housing. Two sets of intake and exhaust ports for the annular operation chamber 5A can be formed in the right wall of the housing 4G. In this way, with two sets of engine being provided on one side of the rotor, the engine can be further reduced in size. Furthermore, four sets of engine can be provided on either side of the rotor. Therefore, the engine EE is useful for large-size marine engines.

Embodiment 12

The above rotary engines are described as ignition engine by way of example in which fuel-air mixture is ignited by a spark plug. The rotary engine of the present invention is applicable to diesel engines in which fuel is injected into compressed air in an auxiliary combustion chamber and ignited using compression ignition. However, in the case of diesel engines, the compression ratio should be increased to approximately 22.

INDUSTRIAL APPLICABILITY

The rotary engine of the present invention can be used in engines using various fuels such as heavy oil, diesel oil, gasoline, ethanol, LPG, natural gas, and hydrogen gas; engines in various applications such as vehicles, construction machinery, agricultural machinery, various industrial machinery, and various cylinder capacity marine engines; and small to large cylinder capacity engines.

What is claimed is:

1. A rotary piston type internal combustion engine comprising an output shaft, a rotor coupled to said output shaft with no relative rotation, a housing rotatably supporting said output shaft, an annular operation chamber formed by said rotor and housing for forming an intake operation chamber, a compression operation chamber, a combustion operation chamber and an exhaust operation chamber, at least one pressuring/pressured member provided to said rotor for partitioning said annular operation chamber and for compressing intake air in the compression operation chamber and receiving gas pressure of combustion gas in the combustion operation chamber, at least one operation chamber partitioning member provided to said housing for partitioning said annular operation chamber, an intake port for introducing intake air into said annular operation chamber, an exhaust port for exhausting gas from said annular operation chamber, and a fuel supply means for supplying fuel, wherein compressed fuel-air mixture is ignited using a spark plug or compression ignition;

said annular operation chamber is formed by at least one of sidewall portions of said rotor in an axial direction of said output shaft and said housing, and has an entirely or mostly cylindrical inner peripheral wall and an entirely or mostly cylindrical outer peripheral wall;

said operation chamber partitioning member comprising a reciprocating partitioning member that reciprocates in parallel to an axis of said output shaft between an advanced position where it partitions said annular operation chamber and a retracted position where it is retracted from said annular operation chamber;

a biasing means for biasing said reciprocating partitioning member toward said advanced position;

said pressuring/pressured member comprising an arc-shaped partitioning member having a first inclined surface for driving said reciprocating partitioning member from said advanced position to said retracted position, a forefront sliding surface continued from said first inclined surface, and a second inclined surface continued from said forefront sliding surface and allowing said reciprocating partitioning member to return from said retracted position to said advanced position;

wherein said annular operation chamber has a rectangular half section with arc-like rounded corners in a plane containing the axis of said output shaft and is constituted by a shallow annular groove formed in said rotor and a deep annular groove formed in said housing;

wherein said shallow annular groove has a first annular wall on a plane orthogonal to the axis of said output shaft and inner and outer corner walls that are on an inner peripheral side and on an outer peripheral side of said first annular wall; and wherein said deep annular groove has an inner cylindrical wall, an outer cylindrical wall, a second annular wall on a plane orthogonal to the axis of said output shaft, and inner and outer corner walls that are on an inner peripheral side and on an outer peripheral side of said second annular wall.

2. The rotary piston type internal combustion engine according to claim 1, wherein an engaging guide mechanism that inhibits said reciprocating partitioning member from moving in a circumferential direction and allows said reciprocating partitioning member to move in parallel to the axis of said output shaft is provided.

3. The rotary piston type internal combustion engine according to claim 1, wherein said biasing means comprises a gas spring biasing said reciprocating partitioning member toward said advanced position.

4. The rotary piston type internal combustion engine according to claim 1, wherein said annular operation chamber is provided on either side of said rotor in the axial direction of said output shaft and said pressuring/pressured member and said operation chamber partitioning member corresponding to these annular operation chambers each are provided.

5. The rotary piston type internal combustion engine according to claim 1, wherein:

said annular operation chamber has a wall parallel to a plane orthogonal to the axis of said output shaft; said wall being formed on said sidewall portion of said rotor; and said reciprocating partitioning member has on a forefront end portion a first sliding surface for making hermetic contact with said first inclined surface of said arc-shaped partitioning member, a forefront sliding surface continued from said first sliding surface and for making hermetic contact with said wall parallel to a plane orthogonal to the axis of said output shaft, and a second sliding surface continued from said front sliding surface and for making hermetic contact with said second inclined surface of said arc-shaped partitioning member.

6. The rotary piston type internal combustion engine according to claim 5, wherein said reciprocating partitioning member has an inner peripheral side sliding surface and an outer peripheral side sliding surface and said inner and outer peripheral side sliding surfaces and first, forefront, and second sliding surfaces of said reciprocating partitioning member are each provided with one or more seal-installation grooves to which lubricating oil is supplied and one or more sealing members movably installed in said sealing-installation grooves.

7. The rotary piston type internal combustion engine according to claim 5, wherein a leading end in a rotor rotation direction of said first inclined surface of said arc-shaped partitioning member is on a line orthogonal to the axis of said output shaft, said first inclined surface has a circumferential inclination progressively decreased in a radially outward direction, a trailing end in the rotor rotation direction of said second inclined surface of said arc-shaped partitioning member is on a line orthogonal to the axis of said output shaft, and said second inclined surface has a circumferential inclination progressively decreased in a radially outward direction.

8. The rotary piston type internal combustion engine according to claim 1, wherein said arc-shaped partitioning member has an inner peripheral side sliding surface making contact with said inner peripheral wall and an outer side peripheral side sliding surface making contact with said outer peripheral wall, and said inner and outer peripheral side sliding surfaces and said forefront sliding surface of said arc-shaped partitioning member are each provided with one or more seal-installation grooves to which lubricating oil is supplied and one or more sealing members movably installed in said seal-installation groove.

9. The rotary piston type internal combustion engine according to claim 1, wherein said pressuring/pressured member provided to said rotor comprises said arc-shaped partitioning member and said housing is provided with as said operation chamber partitioning member a first reciprocating partitioning member and a second reciprocating partitioning member spaced from said first reciprocating partitioning member by at least 180 degrees in a rotor rotation direction.

10. The rotary piston type internal combustion engine according to claim 9, wherein said intake port is formed in a portion of said housing near said second reciprocating partitioning member at a leading side in the rotor rotation direction than said second reciprocating partitioning member, and said exhaust port is formed in a portion of said housing near said second reciprocating partitioning member at a trailing side in the rotor rotation direction than said second reciprocating partitioning member.

11. The rotary piston type internal combustion engine according to claim 10, wherein:

when said pressuring/pressured member is between said intake port and said first reciprocating partitioning member, said intake operation chamber is formed between said second reciprocating partitioning member and said pressuring/pressured member and said compression operation chamber is formed between said pressuring/pressured member and said first reciprocating partitioning member in said annular operation chamber; and when said pressuring/pressured member is between said first reciprocating partitioning member and said exhaust port, said combustion operation chamber is formed between said first reciprocating partitioning member and said pressuring/pressured member and said exhaust operation chamber is formed between said pressuring/pressured member and said second reciprocating partitioning member in said annular operation chamber.

12. The rotary piston type internal combustion engine according to claim 11, wherein said fuel supply means has a fuel injector for injecting fuel into said compression operation chamber and a spark plug for igniting fuel-air mixture in an auxiliary combustion chamber is provided.

13. The rotary piston type internal combustion engine according to claim 12, wherein said fuel supply means has a fuel injector that additionally injects fuel into said combustion operation chamber.

14. The rotary piston type internal combustion engine according to claim 11, wherein said fuel supply means has a fuel injector for injecting fuel into an auxiliary combustion chamber.

15. The rotary piston type internal combustion engine according to claim 11, wherein an inlet passage for connecting said compression operation chamber to an auxiliary combustion chamber, an inlet passage on-off valve for opening/closing said inlet passage, an outlet passage for discharging combustion gas in said auxiliary combustion chamber into said combustion operation chamber, and an outlet passage on-off valve for opening/closing said outlet passage are provided.

16. The rotary piston type internal combustion engine according to claim 11, wherein said fuel supply means has a fuel injector for injecting fuel into said auxiliary combustion chamber and fuel-air mixture in said auxiliary combustion chamber is ignited using compression ignition.

17. A rotary piston type internal combustion engine comprising an output shaft, a rotor coupled to said output shaft with no relative rotation, a housing rotatably supporting said output shaft, an annular operation chamber formed by said rotor and housing for forming an intake operation chamber, a compression operation chamber, a combustion operation chamber and an exhaust operation chamber, at least one pressuring/pressured member provided to said rotor for partitioning said annular operation chamber and for compressing intake air in the compression operation chamber and receiving gas pressure of combustion gas in the combustion operation chamber, at least one operation chamber partitioning member provided to said housing for partitioning said annular operation chamber, an intake port for introducing intake air into said annular operation chamber, an exhaust port for exhausting gas from said annular operation chamber, and a fuel supply means for supplying fuel, wherein compressed fuel-air mixture is ignited using a spark plug or compression ignition;

said annular operation chamber is formed by at least one of sidewall portions of said rotor in an axial direction of said output shaft and said housing, and has an entirely or mostly cylindrical inner peripheral wall and an entirely or mostly cylindrical outer peripheral wall;

said operation chamber partitioning member comprising a reciprocating partitioning member that reciprocates in parallel to an axis of said output shaft between an advanced position where it partitions said annular operation chamber and a retracted position where it is retracted from said annular operation chamber;

a biasing means for biasing said reciprocating partitioning member toward said advanced position;

said pressuring/pressured member comprising an arc-shaped partitioning member having a first inclined surface for driving said reciprocating partitioning member from said advanced position to said retracted position, a forefront sliding surface continued from said first inclined surface, and a second inclined surface continued from said forefront sliding surface and allowing said reciprocating partitioning member to return from said retracted position to said advanced position;

wherein said annular operation chamber has a wall parallel to a plane orthogonal to the axis of said output shaft; said wall being formed on said sidewall portion of said rotor; and wherein said reciprocating partitioning member has on a forefront end portion a first sliding surface for making hermetic contact with said first inclined surface of said arc-shaped partitioning member, a forefront sliding surface continued from said first sliding surface and for making hermetic contact with said wall parallel to a plane orthogonal to the axis of said output shaft, and a second sliding surface continued from said front sliding surface and for making hermetic contact with said second inclined surface of said arc-shaped partitioning member.

18. The rotary piston type internal combustion engine according to claim 17, wherein said annular operation chamber comprises the intake operation chamber, the compression operation chamber, the combustion operation chamber, and an exhaust operation chamber by means of said pressuring/pressured member and said operation chamber partitioning member.

19. The rotary piston type internal combustion engine according to claim 17, wherein said sidewall portion of the rotor is a larger-diameter sidewall portion having a radius of 0.5R or larger from the axis of said output shaft in which R is a radius of said rotor.

20. The rotary piston type internal combustion engine according to claim 17, wherein said annular operation chamber comprises an annular groove recessed in said housing with an opening end facing the rotor and having a rectangular half section in a plane containing the axis of said output shaft and an annular wall of said rotor closing the opening end of said annular groove.

21. The rotary piston type internal combustion engine according to claim 17, wherein said reciprocating partitioning member has an inner peripheral side sliding surface and an outer peripheral side sliding surface and said inner and outer peripheral side sliding surfaces and first, forefront, and second sliding surfaces of said reciprocating partitioning member are each provided with one or more seal-installation grooves to which lubricating oil is supplied and one or more sealing members movably installed in said sealing-installation grooves.

22. The rotary piston type internal combustion engine according to claim 17, wherein a leading end in a rotor rotation direction of said first inclined surface of said arc-shaped partitioning member is on a line orthogonal to the axis of said output shaft, said first inclined surface has a circumferential inclination progressively decreased in a radially outward direction, a trailing end in the rotor rotation direction of said second inclined surface of said arc-shaped partitioning member is on a line orthogonal to the axis of said output shaft, and said second inclined surface has a circumferential inclination progressively decreased in a radially outward direction.

23. A rotary piston type internal combustion engine comprising an output shaft, a rotor coupled to said output shaft with no relative rotation, a housing rotatably supporting said output shaft, an annular operation chamber formed by said rotor and housing for forming an intake operation chamber, a compression operation chamber, a combustion operation chamber and an exhaust operation chamber, at least one pressuring/pressured member provided to said rotor for partitioning said annular operation chamber and for compressing intake air in the compression operation chamber and receiving gas pressure of combustion gas in the combustion operation chamber, at least one operation chamber partitioning member provided to said housing for partitioning said annular operation chamber, an intake port for introducing intake air into said annular operation chamber, an exhaust port for exhausting gas from said annular operation chamber, and a fuel supply means for supplying fuel, wherein compressed fuel-air mixture is ignited using a spark plug or compression ignition;

said annular operation chamber is formed by at least one of sidewall portions of said rotor in an axial direction of said output shaft and said housing, and has an entirely or mostly cylindrical inner peripheral wall and an entirely or mostly cylindrical outer peripheral wall;

said operation chamber partitioning member comprising a reciprocating partitioning member that reciprocates in parallel to an axis of said output shaft between an advanced position where it partitions said annular operation chamber and a retracted position where it is retracted from said annular operation chamber;

a biasing means for biasing said reciprocating partitioning member toward said advanced position;

said pressuring/pressured member comprising an arc-shaped partitioning member having a first inclined surface for driving said reciprocating partitioning member from said advanced position to said retracted position, a forefront sliding surface continued from said first inclined surface, and a second inclined surface continued from said forefront sliding surface and allowing said reciprocating partitioning member to return from said retracted position to said advanced position;

wherein said pressuring/pressured member provided to said rotor comprises said arc-shaped partitioning member and said housing is provided with said operation chamber partitioning member a first reciprocating partitioning member and a second reciprocating partitioning member spaced from said first reciprocating partitioning member by at least 180 degrees in a rotor rotation direction;

wherein said intake port is formed in a portion of said housing near said second reciprocating partitioning member at a leading side in the rotor rotation direction that said second reciprocating partitioning member, and said exhaust port is formed in a portion of said housing near said second reciprocating partitioning member at a trailing side in the rotor rotation direction than said second reciprocating partitioning member;

wherein when said pressuring/pressured member is between said intake port and said first reciprocating partitioning member, said intake operation chamber is formed between said second reciprocating partitioning member and said pressuring/pressured member and said compression operation chamber is formed between said pressuring/pressured member and said first reciprocating partitioning member in said annular operation chamber;

wherein when said pressuring/pressured member is between said first reciprocating partitioning member and said exhaust port, said combustion operation chamber is formed between said first reciprocating partitioning member and said pressuring/pressured member and said exhaust operation chamber is formed between said pressuring/pressured member and said second reciprocating partitioning member in said annular operation chamber; and wherein said fuel supply means has a fuel injector for injecting fuel into said compression operation chamber and a spark plug is provided for igniting fuel-air mixture in an auxiliary combustion chamber positioned in a wall portion of said housing on an output shaft side than said first reciprocating partitioning member.

24. The rotary piston type internal combustion engine according to claim 23, wherein said annular operation chamber comprises the intake operation chamber, the compression operation chamber, the combustion operation chamber, and an exhaust operation chamber by means of said pressuring/pressured member and said operation chamber partitioning member.

25. The rotary piston type internal combustion engine according to claim 23, wherein said sidewall portion of the rotor is a larger-diameter sidewall portion having a radius of 0.5R or larger from the axis of said output shaft in which R is a radius of said rotor.

26. The rotary piston type internal combustion engine according to claim 23, wherein said annular operation chamber comprises an annular groove recessed in said housing with an opening end facing the rotor and having a rectangular half section in a plane containing the axis of said output shaft and an annular wall of said rotor closing the opening end of said annular groove.

27. The rotary piston type internal combustion engine according to claim 23, wherein said fuel supply means has a fuel injector that additionally injects fuel into said combustion operation chamber.

28. A rotary piston type internal combustion engine comprising an output shaft, a rotor coupled to said output shaft with no relative rotation, a housing rotatably supporting said output shaft, an annular operation chamber formed by said rotor and housing for forming an intake operation chamber, a compression operation chamber, a combustion operation chamber and an exhaust operation chamber, at least one pressuring/pressured member provided to said rotor for partitioning said annular operation chamber and for compressing intake air in the compression operation chamber and receiving gas pressure of combustion gas in the combustion operation chamber, at least one operation chamber partitioning member provided to said housing for partitioning said annular operation chamber, an intake port for introducing intake air into said annular operation chamber, an exhaust port for exhausting gas from said annular operation chamber, and a fuel supply means for supplying fuel, wherein compressed fuel-air mixture is ignited using a spark plug or compression ignition;

said annular operation chamber is formed by at least one of sidewall portions of said rotor in an axial direction of said output shaft and said housing, and has an entirely or mostly cylindrical inner peripheral wall and an entirely or mostly cylindrical outer peripheral wall;

said operation chamber partitioning member comprising a reciprocating partitioning member that reciprocates in parallel to an axis of said output shaft between an advanced position where it partitions said annular operation chamber and a retracted position where it is retracted from said annular operation chamber;

a biasing means for biasing said reciprocating partitioning member toward said advanced position;

said pressuring/pressured member comprising an arc-shaped partitioning member having a first inclined surface for driving said reciprocating partitioning member from said advanced position to said retracted position, a forefront sliding surface continued from said first inclined surface, and a second inclined surface continued from said forefront sliding surface and allowing said reciprocating partitioning member to return from said retracted position to said advanced position;

wherein said pressuring/pressured member provided to said rotor comprises said arc-shaped partitioning member and said housing is provided with said operation chamber partitioning member a first reciprocating partitioning member and a second reciprocating partitioning member spaced from said first reciprocating partitioning member by at least 180 degrees in a rotor rotation direction;

wherein said intake port is formed in a portion of said housing near said second reciprocating partitioning member at a leading side in the rotor rotation direction than said second reciprocating partitioning member, and said exhaust port is formed in a portion of said housing near said second reciprocating partitioning member at a trailing side in the rotor rotation direction than said second reciprocating partitioning member;

wherein when said pressuring/pressured member is between said intake port and said first reciprocating partitioning member, said intake operation chamber is formed between said second reciprocating partitioning member and said pressuring/pressured member and said compression operation chamber is formed between said pressuring/pressured member and said first reciprocating partitioning member in said annular operation chamber;

wherein when said pressuring/pressured member is between said first reciprocating partitioning member and said exhaust port, said combustion operation chamber is formed between said first reciprocating partitioning member and said pressuring/pressured member and said exhaust operation chamber is formed between said pressuring/pressured member and said second reciprocating partitioning member in said annular operation chamber; and wherein said fuel supply means has a fuel injector for injecting fuel into an auxiliary combustion chamber provided in a wall portion of said housing on an output shaft side than said first reciprocating partitioning member.

29. The rotary piston type internal combustion engine according to claim 28, wherein said annular operation chamber comprises the intake operation chamber, the compression operation chamber, the combustion operation chamber, and an exhaust operation chamber by means of said pressuring/pressured member and said operation chamber partitioning member.

30. The rotary piston type internal combustion engine according to claim 28, wherein said sidewall portion of the rotor is a larger-diameter sidewall portion having a radius of 0.5R or larger from the axis of said output shaft in which R is a radius of said rotor.

31. The rotary piston type internal combustion engine according to claim 28, wherein said annular operation chamber comprises an annular groove recessed in said housing with an opening end facing the rotor and having a rectangular half section in a plane containing the axis of said output shaft and an annular wall of said rotor closing the opening end of said annular groove.

32. A rotary piston type internal combustion engine comprising an output shaft, a rotor coupled to said output shaft with no relative rotation, a housing rotatably supporting said output shaft, an annular operation chamber formed by said rotor and housing for forming an intake operation chamber, a compression operation chamber, a combustion operation chamber and an exhaust operation chamber, at least one pressuring/pressured member provided to said rotor for partitioning said annular operation chamber and for compressing intake air in the compression operation chamber and receiving gas pressure of combustion gas in the combustion operation chamber, at least one operation chamber partitioning member provided to said housing for partitioning said annular operation chamber, an intake port for introducing intake air into said annular operation chamber, an exhaust port for exhausting gas from said annular operation chamber, and a fuel supply means for supplying fuel, wherein compressed fuel-air mixture is ignited using a spark plug or compression ignition;

said annular operation chamber is formed by at least one of sidewall portions of said rotor in an axial direction of said output shaft and said housing, and has an entirely or mostly cylindrical inner peripheral wall and an entirely or mostly cylindrical outer peripheral wall;

said operation chamber partitioning member comprising a reciprocating partitioning member that reciprocates in parallel to an axis of said output shaft between an advanced position where it partitions said annular operation chamber and a retracted position where it is retracted from said annular operation chamber;

a biasing means for biasing said reciprocating partitioning member toward said advanced position;

said pressuring/pressured member comprising an arc-shaped partitioning member having a first inclined surface for driving said reciprocating partitioning member from said advanced position to said retracted position, a forefront sliding surface continued from said first inclined surface, and a second inclined surface continued from said forefront sliding surface and allowing said reciprocating partitioning member to return from said retracted position to said advanced position;

wherein said pressuring/pressured member provided to said rotor comprises said arc-shaped partitioning member and said housing is provided with said operation chamber partitioning member a first reciprocating partitioning member and a second reciprocating partitioning member spaced from said first reciprocating partitioning member by at least 180 degrees in a rotor rotation direction;

wherein said intake port is formed in a portion of said housing near said second reciprocating partitioning member at a leading side in the rotor rotation direction than said second reciprocating partitioning member, and said exhaust port is formed in a portion of said housing near said second reciprocating partitioning member at a trailing side in the rotor rotation direction than said second reciprocating partitioning member;

wherein when said pressuring/pressured member is between said intake port and said first reciprocating partitioning member, said intake operation chamber is formed between said second reciprocating partitioning member and said pressuring/pressured member and said compression operation chamber is formed between said pressuring/pressured member and said first reciprocating partitioning member in said annular operation chamber;

wherein when said pressuring/pressured member is between said first reciprocating partitioning member and said exhaust port, said combustion operation chamber is formed between said first reciprocating partitioning member and said pressuring/pressured member and said exhaust operation chamber is formed between said pressuring/pressured member and said second reciprocating partitioning member in said annular operation chamber; and wherein said fuel supply means has a fuel injector for injecting fuel into an auxiliary combustion chamber provided in a wall portion of said housing on an output shaft side than said first reciprocating partitioning member and fuel-air mixture in said auxiliary combustion chamber is ignited using compression ignition.

33. The rotary piston type internal combustion engine according to claim 32, wherein said annular operation chamber comprises the intake operation chamber, the compression operation chamber, the combustion operation chamber, and an exhaust operation chamber by means of said pressuring/pressured member and said operation chamber partitioning member.

34. The rotary piston type internal combustion engine according to claim 32, wherein said sidewall portion of the rotor is a larger-diameter sidewall portion having a radius of 0.5R or larger from the axis of said output shaft in which R is a radius of said rotor.

35. The rotary piston type internal combustion engine according to claim 32, wherein said annular operation chamber comprises an annular groove recessed in said housing with an opening end facing the rotor and having a rectangular half section in a plane containing the axis of said output shaft and an annular wall of said rotor closing the opening end of said annular groove.

* * * * *